US009506307B2

(12) United States Patent
Kinsella

(10) Patent No.: US 9,506,307 B2
(45) Date of Patent: Nov. 29, 2016

(54) HIGH PRESSURE CORING ASSEMBLY AND METHOD

(75) Inventor: Douglas Kinsella, Edmonton, CA (US)

(73) Assignee: Corpro Technologies Canada Ltd., Calgary (CA)

( * ) Notice: Subject to any disclaimer, the term of this patent is extended or adjusted under 35 U.S.C. 154(b) by 971 days.

(21) Appl. No.: 13/416,692

(22) Filed: Mar. 9, 2012

(65) Prior Publication Data

US 2012/0234607 A1 Sep. 20, 2012

Related U.S. Application Data

(60) Provisional application No. 61/453,232, filed on Mar. 16, 2011, provisional application No. 61/559,967, filed on Nov. 15, 2011.

(51) Int. Cl.
*E21B 25/02* (2006.01)
*E21B 34/00* (2006.01)

(52) U.S. Cl.
CPC ..... *E21B 25/02* (2013.01); *E21B 2034/005* (2013.01); *Y10T 29/494* (2015.01)

(58) Field of Classification Search
CPC ..... E21B 25/00; E21B 25/02; E21B 25/08
USPC ..... 175/48, 58, 232, 233, 236, 239, 240, 175/244–246, 251
See application file for complete search history.

(56) References Cited

U.S. PATENT DOCUMENTS 1,505,780 A * 8/1924 Hansen ..... E21B 49/02 175/242
2,189,057 A * 2/1940 Copelin ..... E21B 10/64 175/236
2,248,910 A 7/1941 Auld et al.
2,287,909 A * 6/1942 Sewell ..... 175/233
2,347,726 A * 5/1944 Auld ..... 175/233
2,412,915 A 12/1946 Sewell
2,541,785 A 2/1951 Smith
2,664,260 A 12/1953 Knight et al.
2,734,719 A 2/1956 Otway
(Continued)

FOREIGN PATENT DOCUMENTS

DE 36 44 723 A1 7/1988
GB 2 054 703 A 7/1980
(Continued)

OTHER PUBLICATIONS

International Preliminary Report on Patentability from International Bureau dated Sep. 26, 2013.
(Continued)

*Primary Examiner* — William P Neuder
*Assistant Examiner* — Ronald Runyan
(74) *Attorney, Agent, or Firm* — Kenneth L. Nash

(57) ABSTRACT

A wireline or drill pipe retrievable coring tool with an inner barrel to receive a core, a bottom coring tool valve operable to seal off a bottom of the inner barrel and at least one pressure canister operable to receive fluid from the core in the inner barrel. The pressure canister is operable to significantly reduce the pressure inside the inner barrel utilizing an expandable chamber to receive fluid from the core as the tool is removed from the wellbore. In one embodiment, a bottom valve mechanism moves the cored formation materials out of the way of the bottom valve before the bottom valve is closed.

24 Claims, 35 Drawing Sheets

(56) References Cited

U.S. PATENT DOCUMENTS

| | | | | |
|---|---|---|---|---|
| 2,812,160 | A | 11/1957 | West et al. | |
| 2,857,138 | A | 10/1958 | Svendsen et al. | |
| 3,047,081 | A | 7/1962 | Pitcher | |
| 3,064,742 | A | 11/1962 | Bridwell | |
| 3,103,981 | A | 9/1963 | Harper | |
| 3,146,837 | A | 9/1964 | Bridwell | |
| 3,305,033 | A | 2/1967 | Pickard et al. | |
| 3,318,394 | A | 5/1967 | Gleason, Jr. et al. | |
| 3,409,037 | A * | 11/1968 | Nelson | 137/514.7 |
| 3,420,322 | A | 1/1969 | Mark | |
| 3,540,537 | A | 11/1970 | Brown | |
| 3,548,958 | A | 12/1970 | Blackwell et al. | |
| 3,596,723 | A | 8/1971 | Elenburg | |
| 3,603,413 | A | 9/1971 | Grill et al. | |
| 3,627,067 | A | 12/1971 | Martinsen | |
| 3,667,553 | A | 6/1972 | Gill | |
| 3,667,558 | A | 6/1972 | Lambot | |
| 3,739,865 | A | 6/1973 | Wolda | |
| 3,768,547 | A | 10/1973 | Best | |
| 3,777,826 | A | 12/1973 | Wolda | |
| 3,804,438 | A | 4/1974 | Humphries et al. | |
| 3,842,613 | A * | 10/1974 | Becker | 62/48.1 |
| 3,871,487 | A | 3/1975 | Cooper et al. | |
| 3,874,465 | A | 4/1975 | Young et al. | |
| 4,002,213 | A | 1/1977 | Sweeney | |
| 4,014,393 | A | 3/1977 | Hensel, Jr. | |
| 4,047,093 | A | 9/1977 | Levoy | |
| 4,071,099 | A | 1/1978 | Hensel, Jr. | |
| 4,071,153 | A | 1/1978 | Booher | |
| 4,142,594 | A | 3/1979 | Thompson et al. | |
| 4,230,192 | A | 10/1980 | Pfannkuche | |
| 4,256,192 | A | 3/1981 | Aumann | |
| 4,258,803 | A * | 3/1981 | Thompson | E21B 25/08 175/233 |
| 4,311,201 | A | 1/1982 | Stewart et al. | |
| 4,317,490 | A | 3/1982 | Milberger et al. | |
| 4,356,872 | A | 11/1982 | Hyland | |
| 4,371,045 | A | 2/1983 | McGuire et al. | |
| 4,449,594 | A | 5/1984 | Sparks | |
| 4,452,321 | A | 6/1984 | Eriksson | |
| 4,456,079 | A | 6/1984 | Rassieur | |
| 4,466,495 | A | 8/1984 | Jageler | |
| 4,466,497 | A | 8/1984 | Soinski et al. | |
| 4,479,557 | A | 10/1984 | Park et al. | |
| 4,512,419 | A | 4/1985 | Rowley et al. | |
| 4,573,539 | A | 3/1986 | Carroll et al. | |
| 4,598,777 | A | 7/1986 | Park et al. | |
| 4,624,929 | A | 11/1986 | Ullman | |
| 4,638,872 | A | 1/1987 | Park et al. | |
| 4,669,299 | A | 6/1987 | Closmann | |
| 4,679,636 | A | 7/1987 | Rubic | |
| 4,716,974 | A | 1/1988 | Radford et al. | |
| 4,735,269 | A | 4/1988 | Park et al. | |
| 4,784,902 | A | 11/1988 | Crompton | |
| 4,800,969 | A | 1/1989 | Thompson | |
| 4,817,718 | A | 4/1989 | Nielsen et al. | |
| 4,826,354 | A | 5/1989 | Adorjan | |
| 4,834,198 | A | 5/1989 | Thompson | |
| 4,949,582 | A | 8/1990 | Vollweiler | |
| 4,989,678 | A | 2/1991 | Thompson | |
| 5,005,433 | A | 4/1991 | Patton | |
| 5,146,998 | A | 9/1992 | Cordry | |
| 5,154,328 | A | 10/1992 | Gueret | |
| 5,209,310 | A | 5/1993 | Clydesdale | |
| 5,230,390 | A | 7/1993 | Zastresek et al. | |
| 5,253,720 | A | 10/1993 | Radford et al. | |
| 5,263,360 | A | 11/1993 | Blauch et al. | |
| 5,267,620 | A | 12/1993 | Lee | |
| 5,325,930 | A | 7/1994 | Harrison | |
| 5,333,686 | A | 8/1994 | Vaughan et al. | |
| 5,339,915 | A | 8/1994 | Laponte et al. | |
| 5,351,765 | A | 10/1994 | Ormsby | |
| 5,360,074 | A | 11/1994 | Collee et al. | |
| 5,482,123 | A | 1/1996 | Collee | |
| 5,488,876 | A | 2/1996 | Casey et al. | |
| 5,505,098 | A | 4/1996 | Turriff et al. | |
| 5,517,868 | A | 5/1996 | Turriff et al. | |
| 5,546,798 | A | 8/1996 | Collee et al. | |
| 5,560,438 | A | 10/1996 | Collee et al. | |
| 5,568,838 | A | 10/1996 | Struthers et al. | |
| 5,601,152 | A | 2/1997 | Harrison | |
| 5,644,091 | A | 7/1997 | Jacq et al. | |
| 5,667,025 | A | 9/1997 | Haessly et al. | |
| 5,691,488 | A | 11/1997 | Giannone | |
| 5,816,314 | A | 10/1998 | Wiggs et al. | |
| 6,000,438 | A | 12/1999 | Ohrn | |
| 6,009,960 | A | 1/2000 | Leitko, Jr. et al. | |
| 6,029,758 | A | 2/2000 | Novacovicci et al. | |
| 6,047,782 | A | 4/2000 | Ballard et al. | |
| 6,059,053 | A | 5/2000 | McLeod | |
| 6,164,389 | A | 12/2000 | Fanuel et al. | |
| 6,216,782 | B1 | 4/2001 | Skinner | |
| 6,216,804 | B1 | 4/2001 | Aumann et al. | |
| 6,283,228 | B2 | 9/2001 | Collee et al. | |
| 6,425,449 | B1 | 7/2002 | Marshall | |
| 6,702,017 | B1 | 3/2004 | Corrigan | |
| 6,736,224 | B2 | 5/2004 | Klnsella | |
| 7,314,101 | B2 | 1/2008 | Beach | |
| 7,537,062 | B2 | 5/2009 | Hughes | |
| 2003/0066688 | A1 * | 4/2003 | Nicolaas Looijen | E21B 25/00 175/249 |

FOREIGN PATENT DOCUMENTS

| | | |
|---|---|---|
| GB | 2 171 433 A | 2/1985 |
| WO | WO 8809863 | 12/1988 |
| WO | WO 9401653 | 1/1994 |

OTHER PUBLICATIONS

PCT Search Report, Sep. 25, 2012.

* cited by examiner

HIGH PRESSURE CORING ASSEMBLY AND METHOD

This application claims benefit of U.S. patent application No. 61/453,232, filed Mar. 16, 2011 and U.S. patent application No. 61/559,967, filed Nov. 15, 2011. The above applications are incorporated herein by reference.

BACKGROUND OF THE INVENTION

1. Field of the Invention

The present invention relates generally to coring tools and, more particularly, to a coring tool which provides a more accurate determination of the gas and liquids in the core even when the core is taken at significant depths and high pressure formations.

2. Description of the Background

The goal behind a pressure coring tool is to bring an in situ sample of the core to surface. Ideally, the core would still contain all of the gas and various fluids that the core originally contained when captured at reservoir pressure. If the core samples are the same as they were when captured, subsequent measurements can be used to estimate the reserve gas in the formation.

However, problems arise with conventional coring tools because many presently produced formations are at 10,000 feet and greater where pressures range from 7500-12000 psi.

One approach in the past to this problem has been to attempt to create a chamber and a valve that are capable of holding the high bottom hole pressures, as well as the fluids and gases, as the core is retrieved to the surface from 10000 feet or more in a well bore. However, such attempts have been unsuccessful due to numerous problems.

For example, after retrieval, the coring tool contained the very high and dangerous pressure on the surface. This makes the coring tool difficult to handle and potentially quite dangerous to the drilling crew as the core is removed from the well.

In some cases, the valve may malfunction and is kept open or partially open by the core itself, thereby losing a significant amount of fluids and gases. A malfunctioning valve might also suddenly release pressure at the surface, which could produce a dangerous high pressure spray.

This prior art design requires a high pressure chamber and high pressure valve, which results in greatly limiting the volume of the retrieved core so that only a one to two inch diameter core might be obtained from an eight and one half inch borehole. As well, the cores from such tools were very short. Smaller cores are inherently less desirable and/or reliable for calculations.

Another approach has been to use estimation calculations, which were successful at shallower depths, e.g., for relatively shallow coal bed methane (CBM) formations. However, over the past years, new sources of natural gas formations have been developed at considerably greater depths and pressures for which the estimation calculations are no longer accurate. For example, a present trend involves producing shale gas from the deeper formations. To determine the amount of natural gas contained in the CBM formations, the core was put into canisters after the core was brought to surface. The canisters were sealed but left at atmospheric pressure to allow all of the gas to "bleed" out. The gas was then measured. Through specifically derived calculations, the amount of gas the reservoir contained could be determined.

Wire line coring was a integral part of this equation because after cutting the core, the core could be retrieved to the surface within minutes, therefore minimizing the gas that was lost during the trip out of the hole. The amount of gas lost from the time the core was subjected to a lesser pressure than reservoir pressure (once tripping out of the well bore had begun) could only be estimated from calculations. As well, in coal cores, the gas "bleeds" out the core slowly. So when combined with the fast tripping of wire line coring, the back calculations were very accurate.

When the exploration of shale gas began, the gas community thought it would be possible to apply the same calculations to shale and the problem would be solved. There were two major issues: (1) The new shale gas formations were at much greater depths than the shallow coal seams of CBM. This meant that the differential pressure from reservoir pressure to atmospheric was much greater, which forced more gas out before the core was at surface, and (2) Most of the new shale gas formations contained as much as 95% "free gas". This term means just what it suggests, 95% of the gas is lost due to the pressure decrease while tripping out of the hole, so it only leaves 5% to be analyzed. Back calculating with any degree of accuracy from the 5% content remaining in the core is virtually impossible.

General background prior art patents include the following:

United States Patent Application 2012/0037427 to Douglas Kinsella, filed Aug. 10, 2010, discloses a drill string assembly that has the capability of operating in well bores that range in hole size from seven to eight inches in diameter and is incorporated herein by reference. The assembly is used to obtain a large core sample size that is equal to three and one-half inches in diameter and up to ninety feet in length in a single core run. This assembly will be operated with a drill string (i.e. drill pipe) that is capable of being used on standard drilling rigs, which may be used to handle API style drill pipe to conduct coring/drilling operations. The coring tool is comprised of an inner barrel for receiving the core sample.

U.S. Pat. No. 6,736,224 to Douglas Kinsella, issued May 18, 2004, discloses a wellbore assembly that is operable in wellbores in the range of six to six and one-half inches for obtaining large diameter cores, e.g., cores greater than or equal to two and seven-eighths inches in diameter and is incorporated herein by reference. The wellbore assembly may preferably be utilized with drill pipe so that standard drilling rigs may be utilized in drilling and coring operations therewith. The drill pipe in accord with the present invention may be formed by modifying standard API drill pipe such as API four and one-half inch IF (Internal Flush) drill pipe in a special manner that renders the drill pipe still suitable for the type of drilling operations of interest and also suitable for handling by any drilling rig capable of using standard API drill pipe. Alternatively, the drill piper may be initially manufactured in accord with the specifications of the present invention. The coring tool preferably comprises an inner core barrel for receiving the core and, in a presently preferred embodiment, may be sized to obtain a core having an outer diameter from about three to three and one-half inches.

Accordingly, it would be desirable to provide a pressure coring tool that provides improved capture of gas and fluids present when the core is initially taken at down hole depth and pressure. Consequently, there remains a long felt need for an improved coring tool. Those skilled in the art have long sought and will appreciate the present invention which addresses these and other problems.

SUMMARY OF THE INVENTION

It is an object of the present invention to provide an improved coring tool which provides larger cores and more accurate results even when working at significant depths and pressures.

It is one possible object of the present invention to provide a coring tool that utilizes the decreasing well bore drilling fluid pressure as the tool is tripped out of the hole to activate mechanisms for collecting fluids (gas and liquids) and/or expelling fluids from a core.

It is one possible object of the present invention to provide an improved bottom valve mechanism for sealing off the bottom of an inner core barrel prior to retrieving the core with wireline or drill pipe.

The present invention is not limited to use with wireline and could be utilized for drill pipe coring operations, where the entire tool is retrieved by tripping the drill pipe. When running the tool on the end of drill pipe, where the tool is retrieved by tripping the drill pipe in a conventional manner, the tool is capable of retrieving at least three inch diameter cores from 6 inch and larger hole sizes.

These and other objects, features, and advantages of the present invention will become apparent from the drawings, the descriptions given herein, and the appended claims. However, it will be understood that above-listed objectives and/or advantages of the invention are intended only as an aid in quickly understanding aspects of the invention, are not intended to limit the invention in any way, and therefore do not form a comprehensive or restrictive list of objectives, and/or features, and/or advantages.

Accordingly, in one possible embodiment, the present invention provides a coring tool that allows retrieval of usable 3" cores in seven and seven-eights well bore at high pressures and depths. In this embodiment, because the chamber and valve do not have to contain very high pressure, significantly more room is available in the inner barrel for the core.

In one possible embodiment, a coring tool bottom valve in accord with one possible embodiment of the invention moves the core out of the way of the bottom valve prior to closing the bottom valve.

In one possible embodiment, the core and/or the bottom valve are moved by tool operation so that the bottom of the core moves above or toward the surface before closing the bottom valve to avoid problems with the core interfering with valve operation.

In one possible embodiment, the core chamber pressure is allowed to decrease as the core tool is retrieved to a lower pressure utilizing a pressure differential valve mechanism in fluid communication with the coring chamber, that utilizes the differential pressure to push fluids and gas from the core into storage canisters during the ascent. This results in a lower pressure core chamber that is much safer to handle at the surface as well as capture of all or virtually all of the fluids and gases that were originally in the core sample when captured. In one embodiment, one or more 10 foot cores may be obtained and/or the tool may be converted to one or more 30, 60, or 90 foot standard cores without the need to trip the pipe from the well.

In one possible embodiment, the present invention provides a wireline or drill pipe operable coring tool, which may comprise elements such as, for example, an inner barrel which is operable to receive a core, a bottom coring tool valve operable to seal off a bottom of the inner barrel below the core and at least one pressure canister operable to receive fluid from the core in the inner barrel.

The wireline or drill pipe operable coring tool may further comprise at least one differential pressure operated valve which controls fluid communication from the core in the inner barrel to the at least one pressure canister.

In one possible embodiment, the bottom coring tool valve is responsive to pulling from the wireline to close the bottom coring tool valve. Although, the present invention could possibly utilize other valve mechanisms to close the bottom of the inner barrel, in one embodiment the bottom valve is moveable relative to the core so that the core is above the bottom valve in the inner barrel prior to closing the valve to avoid jamming of the bottom valve operation by the core.

In one possible embodiment, the differential pressure operated relief valve between the pressure canister and the inner barrel opens during the ascent to the surface to permit fluid communication between the at least one pressure canister and the inner barrel, which saves the fluids coming out of the core and at the same time reduces the pressure within the inner barrel to a safer level. Multiple differential pressure operated relief valves may be connected to operate sequentially to continue to save the fluids and maintain the pressure in the inner barrel at a safer level.

In one embodiment, the differential pressure operated relief valve(s) operate responsively to a differential pressure between a well bore drilling fluid column pressure and a pressure inside the inner barrel.

The pressure canister may define a well bore opening that permits fluid communication of the well bore drilling fluid pressure into the pressure canister to thereby provide the decreasing well bore drilling fluid pressure with respect to pressure in the inner core and/or in other pressure canisters. The differential pressure, which is limited to a desired level, e.g. 500 psi, so that at the surface atmospheric pressure, the inner barrel pressure is limited to a maximum of the desired pressure, e.g., 500 psi. While 500 psi is one possible optimal pressure, a limited pressure might be in the range of 400-600 psi in one embodiment, or 300-700 psi in another embodiment, or generally less than 1000 psi. However, other ranges could also be selected if desired.

The wireline or drill pipe operated coring tool may further comprise piston(s) in the pressure canister(s) that are moveable to a position to seal off the well bore opening in response to changing well bore drilling fluid pressure. By blocking off the well bore opening, well bore drilling fluid pressure is then utilized to operate the next differential pressure operated relief valve between the next pressure canister in the line. Thus, the wireline or drill pipe operated coring tool may, if desired, comprise multiple pressure canisters and multiple differential pressure operated relief valves which can be connected, if desired, to sequentially open as the coring tool is brought to the surface and thereby control fluid communication between the core and the multiple pressure canisters.

In one possible embodiment, the bottom coring tool valve may comprise a collapsible (rigid material such as metal or plastic or other hard material) portion and an electrometric tubular within the collapsible portion. The collapsible portion may comprise slots, indentions, openings, weakened regions, thinner regions and the like. The weakened portions of the collapsible portion cause the collapsible portion to collapse into a predetermined collapsed configuration which pinches off the elastomeric material to thereby seal the bottom coring tool valve by compressing the electrometric or any heat/fluid suitable flexible sealing material into a closed end. In another embodiment, the bottom hole coring valve might comprise a spring loaded flapper valve that seals shut and is further sealed off due to the differential pressure. In yet another embodiment, the bottom valve may comprise a ball valve.

In one possible embodiment, the wireline or drill pipe operated coring tool may further comprise a valve actuator to operate the valve and in one possible embodiment comprise means for moving the core above the valve prior to the valve closing off the bottom of the tool.

In another possible embodiment, the valve actuator comprises a lower activator portion and an upper activator portion, which initially support the valve in the open position during coring. The upper activator portion and the lower activator portion are moveable with respect to each other, preferably in response to upward force produced by the wireline, to collapse the collapsible portion to thereby seal the bottom coring tool valve.

In another possible embodiment, the present invention provides a method for making a wireline or drill pipe operable coring tool, which may comprise steps such as, for example, providing an inner barrel which is operable to receive a core, providing a bottom coring tool valve operable to seal off a bottom of the inner barrel, and providing at least one pressure canister operable to receive fluid from the core in the inner barrel.

The method may in one possible embodiment further comprise providing at least one pressure canister valve between the pressure canister and the inner barrel, which when open permits fluid communication between the at least one pressure canister and the inner barrel.

In one possible embodiment, the method may comprise utilizing decreasing well bore drilling fluid pressure as the tool is retrieved to the surface to cause fluid flow from the core in the inner barrel to the at least one pressure canister.

In one possible embodiment, the method may comprise providing that the at least one valve is opened responsively to a differential pressure between the pressure canister and the core in the inner barrel.

The method may comprise providing that the bottom coring tool valve is moveable with respect to the core in the inner barrel to a position below the core in the inner barrel.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings, wherein like reference numerals refer to like parts and wherein.

While the present invention will be described in connection with presently preferred embodiments, it will be understood that it is not intended to limit the invention to those embodiments. On the contrary, it is intended to cover all alternatives, modifications, and equivalents included within the spirit of the invention and as defined in the appended claims.

DETAILED DESCRIPTION OF THE PREFERRED EMBODIMENTS

The present invention can be utilized to capture the fluid and gas of larger cores of shale formations taken at higher pressures and depths. Most of the shale gas reservoirs are at 7000 to 12000 psi.

In one embodiment, the present invention utilizes decreasing well bore drilling fluid pressure as the core moves up the wellbore to activate coring assembly mechanisms to collect all or essentially all the gas and liquids that are expelled while the core is tripped out of the hole.

In one embodiment, the present invention avoids the problem of holding the core at high reservoir pressures, which are dangerous at the surface.

In one possible embodiment, the coring tool of the present invention provides a bottom valve mechanism which allows capturing the core and closing the bottom of the inner barrel after coring is completed. but prior to lifting off the bottom of the well bore.

Figure 1A:
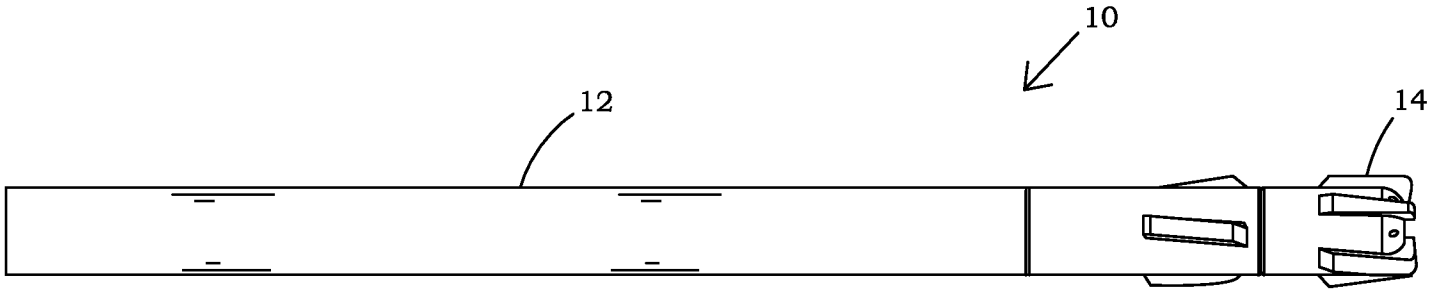
FIG. 1A is an elevational view showing an external view of a coring tool in accord with one possible embodiment of the present invention.

Referring to FIG. 1A, there is shown an external view of one possible embodiment of coring tool 10, which includes outer body 12 and core bit 14. Outer body (also referred to herein as outer barrel) 12 is rotated by the drill string, which in turn rotates core bit 14 as is well known in the art. In one possible embodiment, coring bit 14 may drill a 7⅞ inch diameter hole and still retrieve a relatively large three inch diameter core. In one embodiment, the core length retrieved under the high pressure conditions as discussed above may be ten feet and/or the coring tool could be converted to a 30, 60, or 90 foot standard core without tripping the drill pipe to change the outer barrel of the coring tool.

Figure 1B:
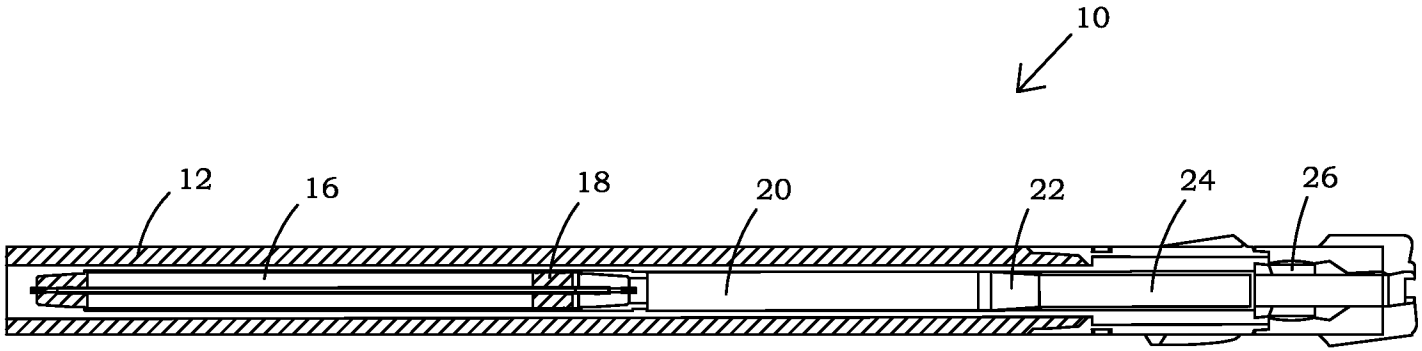
FIG. 1B is an elevational view, in section, showing a coring tool with labeled internal elements in accord with one possible embodiment of the present invention.

FIG. 1B shows various components within the embodiment of FIG. 1A, but it will be understood that the invention is not limited to this particular configuration. Pressure canister 16 is positioned above inner barrel 20 to receive fluids including gas and liquids. As discussed hereinafter, piston 18 moves in response to a differential pressure as the inner barrel components of coring tool 10 are retrieved by wireline or drill pipe. Wireline or drill pipe retrieval of coring tools is well known in the art. Core catcher 22 may be utilized to secure the core in position. Bottom valve and valve actuator mechanism 24, which may be of various types, is utilized to tightly seal off the bottom of inner barrel 20. In one possible embodiment, bit/shank latch 26 and/or other latches may be utilized to secure the internal components of coring tool 10 in position during drilling and to provide tension on valve actuator mechanism 24 when pulling with the wireline to operate valve actuator mechanism 24.

Figure 2A:
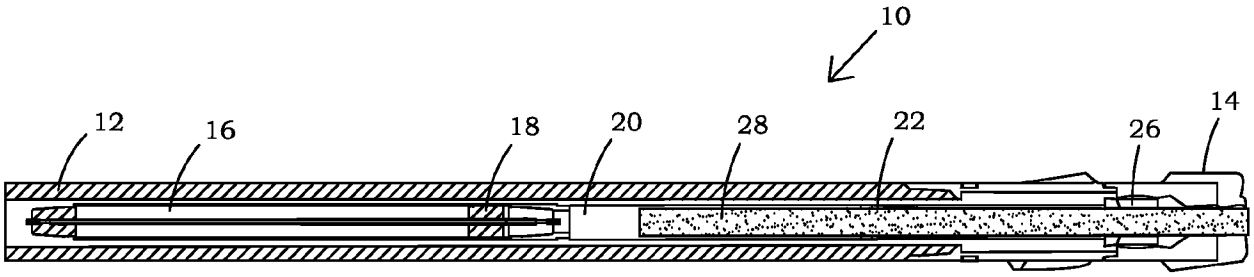
FIG. 2A is an elevational view, in section, showing the core capture operation wherein the core is initially captured within the inner barrel and held in place therein by the core catcher in accord with one possible embodiment of the present invention.

FIGS. 2A, 2B, 2C, and 2D show an overview of a sequence of core capture operation in accord with one possible non-limiting embodiment of the invention. In FIG. 2A, core 28, which may be a ten foot three inch diameter core, is captured during coring and held in place with core catcher 22. Core 28 may be captured in a high pressure formation.

Figure 2B:
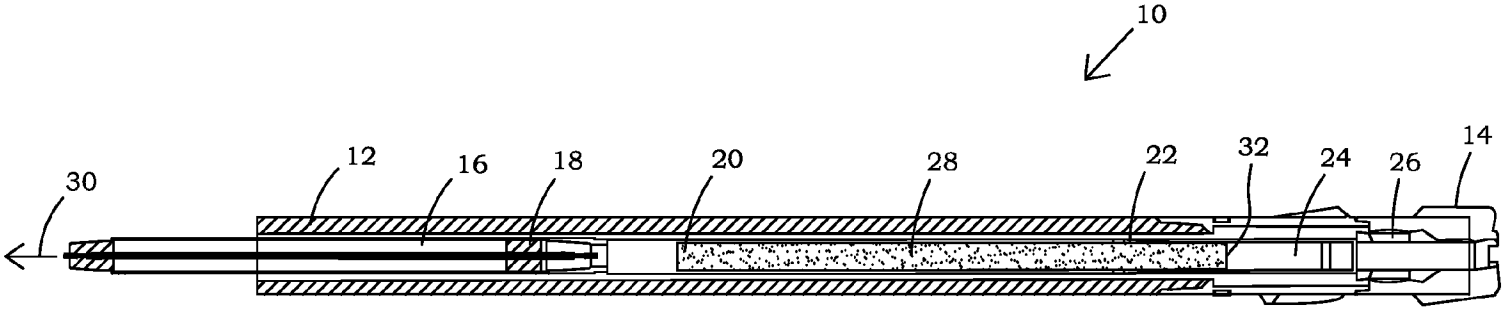
FIG. 2B is an elevational view, in section, showing the core capture operation wherein the canisters and inner barrel of the inner coring tool are pulled upwardly (e.g. using wireline) whereby the core moves upwardly with respect to the outer barrel of the coring tool and a bottom valve such that the bottom valve is then positioned below the core in accord with one possible embodiment of the present invention.

In FIG. 2B, wireline pull as indicated by arrow 30 is utilized to pull one or more canisters 16 and inner barrel 20 upwardly or toward the surface with respect to outer body or outer barrel 12. In this embodiment, core catcher 22 or other component may be utilized to engage an activation sleeve for the bottom valve and valve actuator mechanism 24, some examples of which are discussed hereinafter. It will be noted that during this initial operation, bottom 32 of core 28 is moved upwardly above bottom valve and valve actuator 24 while bit/shank latch 26 remains engaged.

Figure 2C:
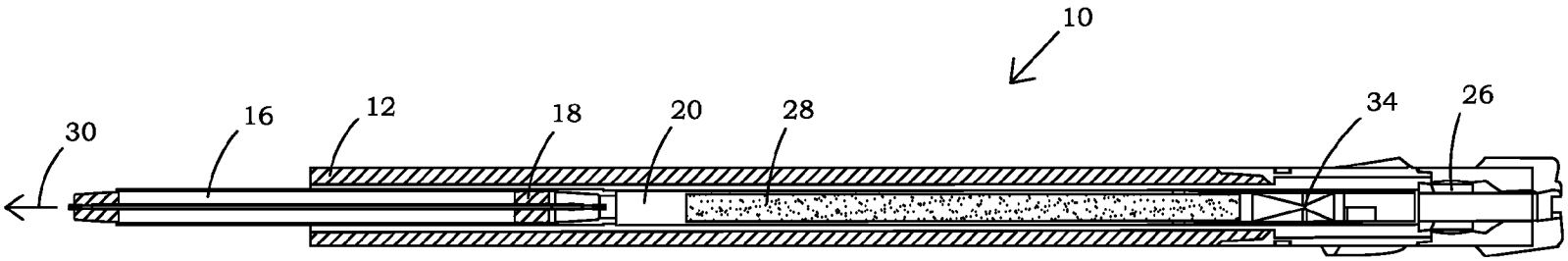
FIG. 2C is an elevational view, in section, showing the core capture operation wherein the bottom valve in the coring tool that is now located below the core closes to seal off the bottom of the coring tool in accord with one possible embodiment of the present invention.

In FIG. 2C, additional pulling upwards with the wireline as indicated by arrow 30 with bit/shank latch still engaged creates tension in bottom valve and valve actuator mechanism that results in closing bottom valve and valve actuator mechanism 24 as indicated by the closed portion 34 of the bottom valve. As discussed hereinafter, various embodiments for the bottom valve may be utilized.

Figure 2D:
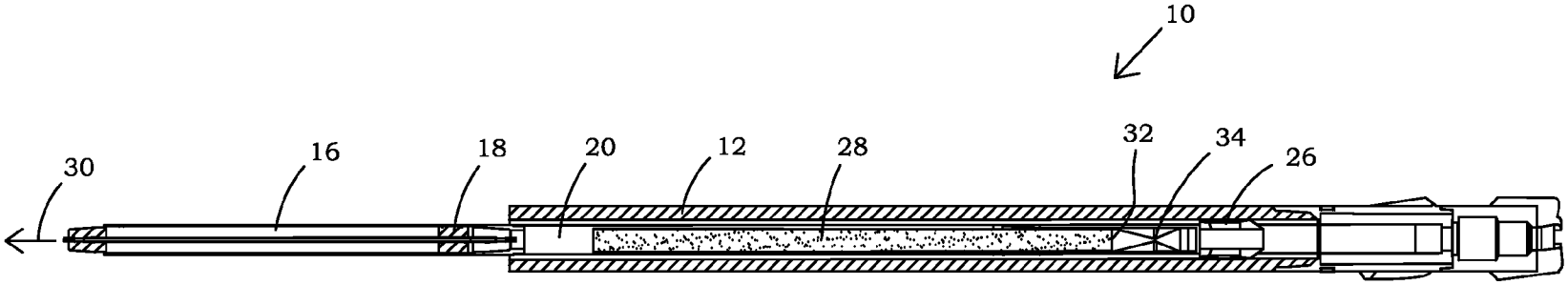
FIG. 2D is an elevational view, in section, showing the core capture operation wherein as the wireline continues to pull at the top of the inner coring tool, the bit/shank latch releases, and the coring tool containing the core initially at high pressure of the bottom hole wellbore pressure can then be pulled out of the well bore in accord with one possible embodiment of the present invention.

In FIG. 2D, additional pulling upward with the wireline as indicated by arrow 30 releases bit/shank latch 26 and the inner coring tool can now be pulled out of the hole through the drill pipe. Essentially, the length of the retrievable portion of the coring tool is expanded or increased during this process so that the bottom of the core is moved out of the way of the bottom valve for more reliable valve operation.

In this embodiment, the core is moved out of the way of the bottom valve by movement of the tool. In another embodiment, the core may be cut off above the bottom valve and/or any remaining core is flushed out of the way of the bottom valve by directing circulating fluid thought the bottom valve prior to closing the bottom valve. However, the tool may be moved to cause a change in direction of the circulation fluid through the bottom valve, if desired. In other words, the disclosed embodiments provide an inventive concept that may be implemented in different mechanical ways. Additional embodiments are discussed hereinafter.

Figures 3A, 3B, 3C:
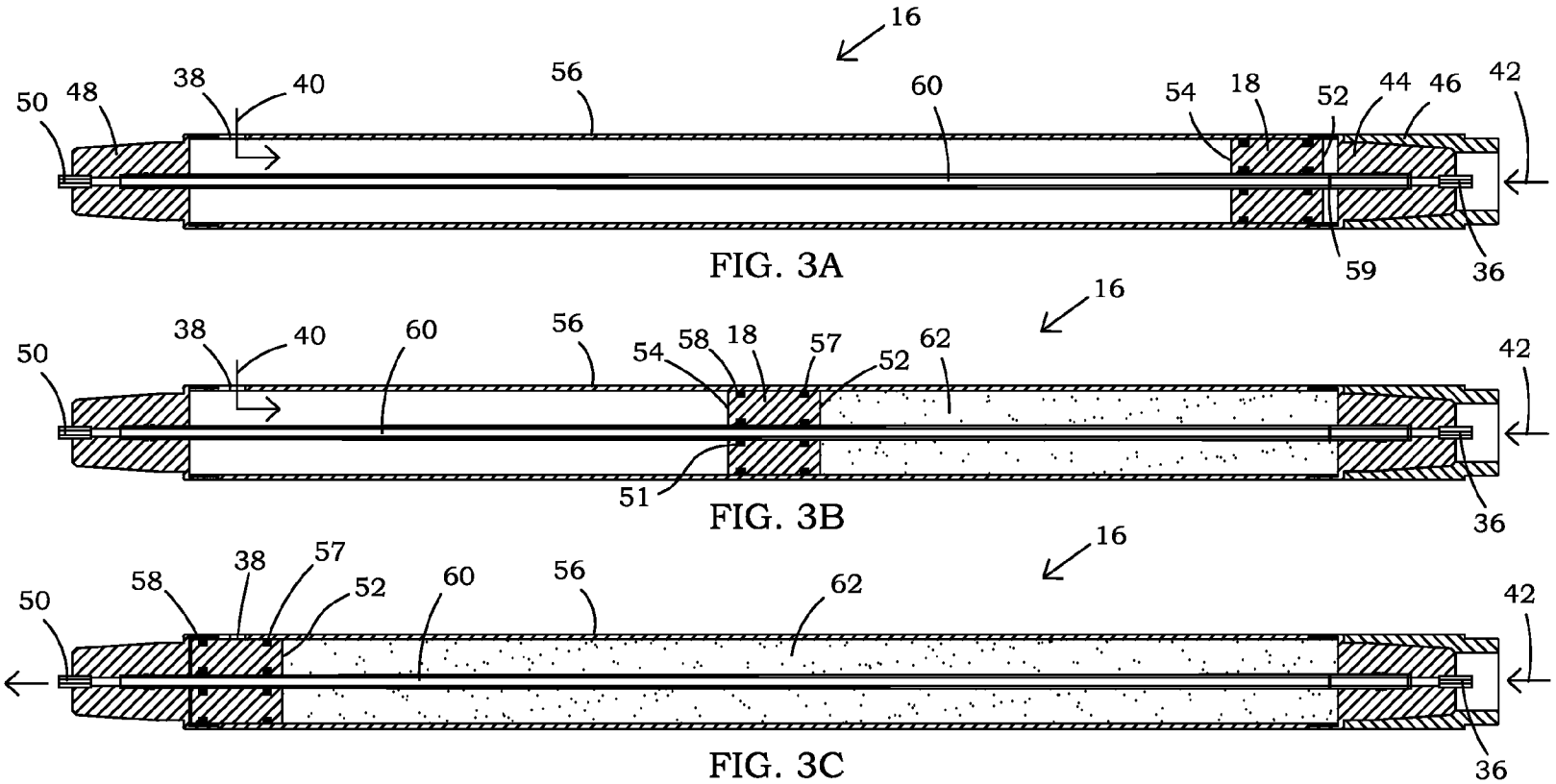
FIG. 3A is an elevational view, in section, showing the pressure canister operation as the coring tool ascends but prior to operation of the first canister relief valve as the wireline or drill pipe tool pulls the inner coring tool up the borehole so that the well bore drilling fluid pressure decreases until reaching the desired differential pressure which operates the relief valve in accord with one possible embodiment of the present invention.
FIG. 3B is an elevational view, in section, showing the pressure canister operation as the wireline or drill pipe tool pulls the inner coring tool up the borehole so that the well bore drilling fluid pressure decreases, thereby increasing the differential between the canister and the core in the inner barrel until the relief valve opens to thereby collect fluid (liquid and gas) from the core into the canister, which operates a piston in the canister, in accord with one possible embodiment of the present invention.
FIG. 3C is an elevational view, in section, showing the pressure canister operation as the wireline or drill pipe tool pulls the inner coring tool up the borehole so that as the well bore drilling fluid pressure decreases the fluid (gas and liquids) from the core fill the canister, pushes the canister piston until the canister piston blocks the well bore drilling fluid pressure vent, whereby the second relief valve of the second canister is now subject to differential pressure changes, and upon reaching the desired differential pressure, the second relief valve opens to allow fluid flow into the second canister (and likewise additional canisters) to collect fluid and gas from the core in multiple canisters in accord with one possible embodiment of the present invention.

As the tool is pulled upwardly toward the surface, the well bore drilling fluid pressure decreases, thereby increasing the relative pressure within captured core 28. FIG. 3A, FIG. 3B, and FIG. 3C illustrate one possible embodiment the general operation of one or more pressure canisters 16 as the tool moves towards the surface.

In FIG. 3A one embodiment of fluid canister 16 is shown, which is utilized to capture gases and/or fluids from the captured core. In this embodiment, canister 16 may comprise canister outer housing 56. Canister top sub 48 and canister bottom sub 44 may be threadably attached to canister outer housing 56. Inner barrel 20 may be threadably secured to bottom sub 44 utilizing inner barrel connector 46. Canister bottom sub 44 may have canister bottom relief valve 36 mounted therein and canister top sub 48 may have canister top relief valve 50 built therein.

Core pressure, as indicated by arrow 42, from the sealed inner core barrel 20 due to captured core 28 is applied to canister bottom relief valve 36. Once the operational differential pressure of relief valve 36 is reached, which may be in the range of 500 psi or other desired canister pressure as discussed earlier, then core pressure 42 is applied to lower side 52 of piston 18 through vent 59 in tube 60. The other end of tube 60 is sealed off by canister top relief valve 50.

In one embodiment, well bore drilling fluid pressure as indicated by arrow 40, which is applied to the top side 54 of piston 18 enters into canister outer housing 56 through wellbore vent 38. Thus, wellbore fluid and pressure engages top side 54 of piston 18. However, the well bore drilling fluid pressure may be passed through pressure reducers, applied to pistons, and/or the like as desired.

Referring to FIG. 3B, as canisters 16 are pulled towards the surface, the well bore drilling fluid pressure decreases causing the relatively higher core pressure and fluid 62 to move piston 18 as shown and enter canister 16 adjacent bottom side 52 of piston 18. Essentially, the region below piston 18 forms an expandable chamber in which the fluid (gases/liquids) from the core is received. Piston 18 has upper seals 58 and lower seals 57, which seal with an interior surface of canister outer housing. In this embodiment, piston 18 also has interior seals 51, which seal around tube 60.

In FIG. 3C, due to the continuously decreasing well bore drilling fluid pressure, piston 18 has been moved to the end of canister outer housing 56, so that the expandable chamber below piston 18 is now completely filled with core fluid 62. Upper and lower seals 58 and 57 seal off wellbore vent 38. While the pressure within canister 56 has been limited due to well bore drilling fluid pressure due to vent 38, at this time with wellbore vent 38 sealed off, the differential pressure across canister top relief valve 50 increases until valve 50 opens and the next canister, which is similar to canister 16 starts to fill in the same way. The number of canisters may be selected to ensure capture of all core fluid and/or may be vented to the wellbore in a final stage. One way relief valves, different relief valve opening pressures, additional valves controlled by piston 18 movement, and the like may be utilized, if desired, to close off the filled canisters and/or provide additional controls.

In another embodiment, flow tube 60 may be eliminated and the length of canister 16 may increased although this increases the weight of the canister. in another embodiment, the canister may simply be an extension of the inner barrel with a piston provided to form an expandable chamber. Accordingly, the disclosed embodiments illustrate an inventive concept of operation which may be implemented in different ways.

FIG. 4A, FIG. 4B, FIG. 5A and FIG. 5B show one possible embodiment for bottom valve 23, which is part of bottom valve and valve actuator 24 discussed hereinbefore. Other particular embodiments for a bottom valve are shown, for example, in FIG. 15A, FIG. 15B, FIG. 15C, and FIG. 15D. However, other types of valves such as ball valves, or the like may, also be utilized. Accordingly, the invention is not limited to a particular type of bottom valve.

Figure 4A:
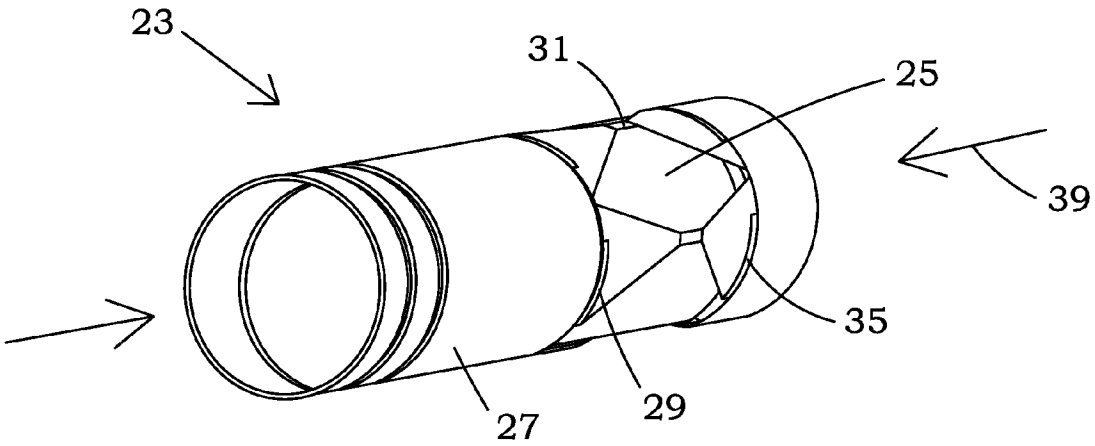
FIG. 4A is a perspective view showing the external surface of a bottom valve when the bottom valve is in the open position in accord with one possible embodiment of the present invention.
Figure 4B:
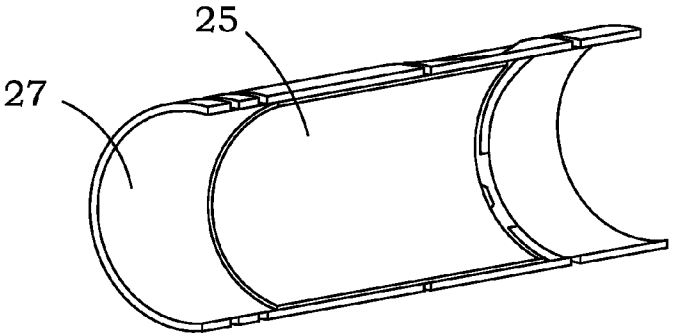
FIG. 4B is a perspective view, in section, showing internal surfaces of bottom valve when the bottom valve is in the open position in accord with one possible embodiment of the present invention.
Figure 5A:
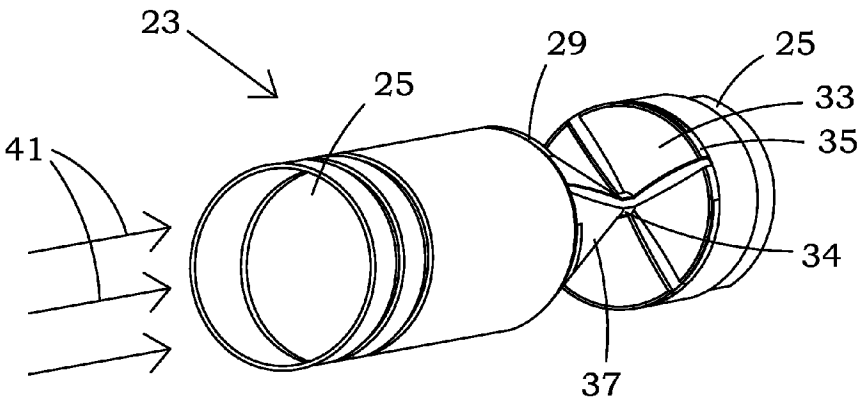
FIG. 5A is a perspective view showing the external surface of a bottom valve when the bottom valve is in the closed position in accord with one possible embodiment of the present invention.
Figure 5B:
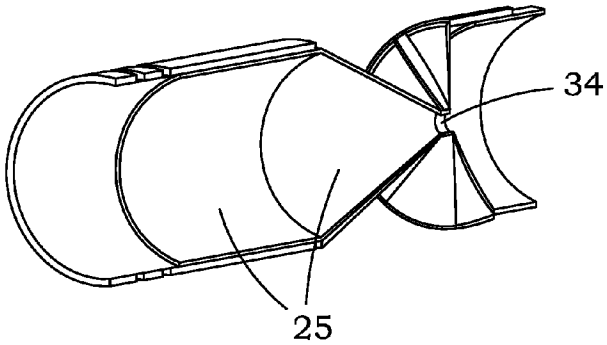
FIG. 5B is a perspective view, in section, showing internal surfaces of a bottom valve when the bottom valve is in the closed or sealed position in accord with one possible embodiment of the present invention.

FIG. 4A shows bottom valve 23 prior to operation. In this embodiment, bottom valve 23 includes collapse tube 27, which collapses along at weakened sections 29, 31, and 35 which encircle bottom valve 23 in response to compressive force applied across bottom valve 23 as indicated by arrow 39. The collapsed valve is shown in FIG. 5A, whereby core pressure, as indicated by core pressure arrows 41 is trapped within the inner core barrel. The collapsible metallic sections 37 and 33 are pressed inwardly thereby squeezing tubular inner elastomeric element 25 at closed off region 34. FIG. 4A shows a sectional view of inner elastomeric element 25 within collapse tube 27 prior to operation and FIG. 5A shows a sectional view of closed bottom valve or seal 34 after collapse tube 27 has been collapsed thereby pinching elastomeric element 25 tightly closed.

Figure 6A:
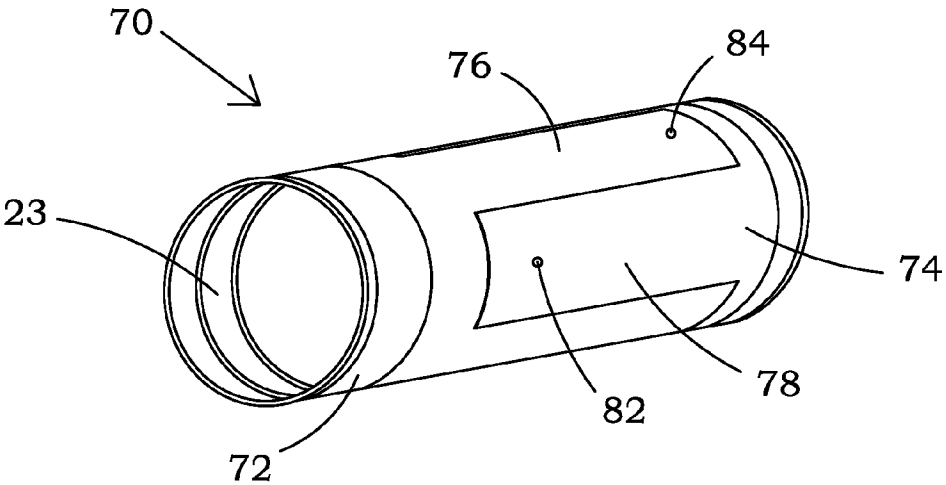
FIG. 6A is a perspective view showing the external surfaces of a possible bottom valve activator with bottom valve contained therein while the bottom valve actuator supports the bottom hole valve in the open position in accord with one possible embodiment of the present invention.
Figure 6B:
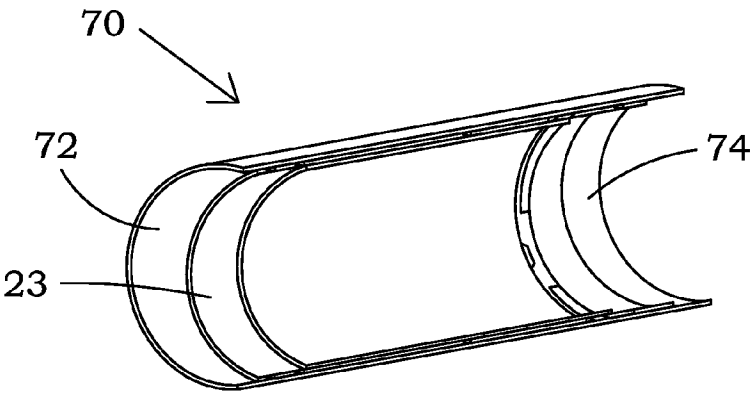
FIG. 6B is a perspective view, in section, showing the internal surfaces of a bottom valve activator with bottom valve contained therein while the bottom valve actuator supports the bottom hole valve in the open position in accord with one possible embodiment of the present invention.

FIG. 6A, FIG. 6B, FIG. 7A, and FIG. 7B show valve actuator 70, across which tension is applied as the wireline pulls upwardly and bit/shank latch remains engaged. Valve actuator 70 comprises upper actuator 72 and lower actuator 74, which slide with respect to each. In this embodiment, upper actuator 72 and lower actuator 74 comprise mating fingers 76 and 78, which slide with respect to each other in response to the coring tool being pulled upwardly by the wireline. FIG. 6A shows a cut away of bottom valve 23 within valve actuator 70 prior to the operation of closing the valve.

Figure 7A:
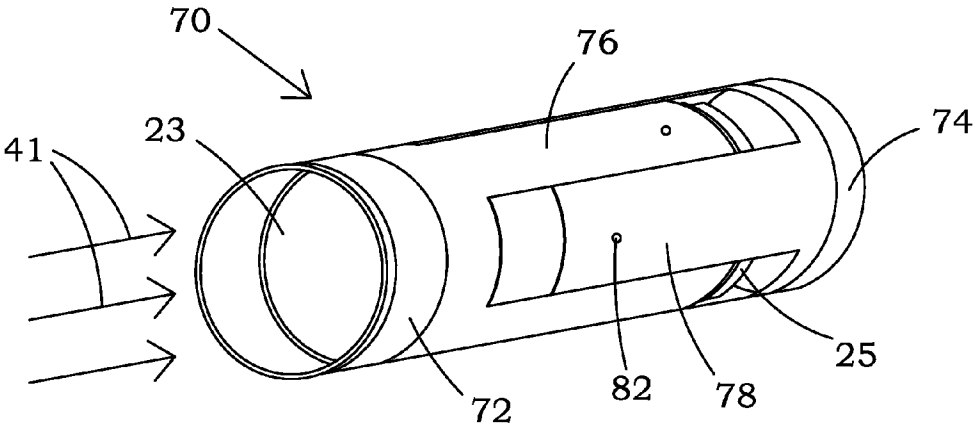
FIG. 7A is a perspective view showing external surfaces of a bottom valve activator with bottom valve contained therein after the bottom valve activator components are moved to place the bottom valve in the closed or sealed position in accord with one possible embodiment of the present invention.
Figure 7B:
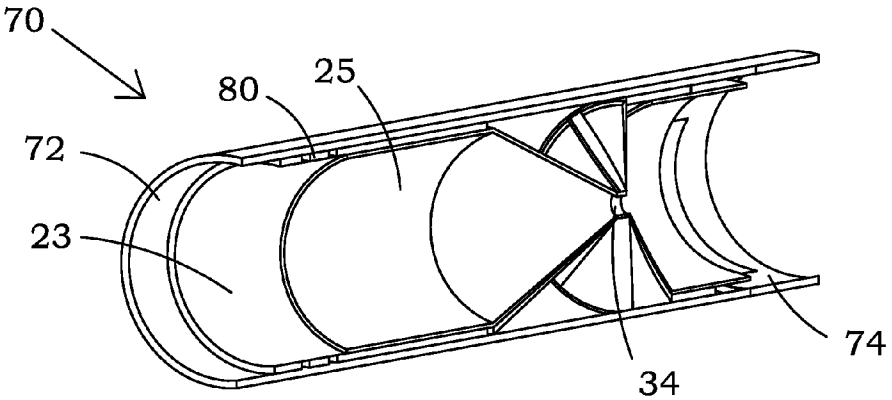
FIG. 7B is a perspective view, in section, showing internal surfaces of a bottom valve activator with bottom valve contained therein after the bottom valve activator components are moved to place the bottom valve in the closed or sealed position in accord with one possible embodiment of the present invention.

Fasteners 82 and 84 may be utilized to connect valve actuator 70 to upper and lower portions of bottom valve 23 with the collapsible portions being positioned therebetween. As shown in FIG. 7A, when the wireline pulls the coring tool upwardly, fingers 76 and 78 slide with respect to each other thereby collapsing bottom valve 23 and producing the collapsed valve seal region 34 as shown in FIG. 7B. Seal 80 may be utilized between upper actuator 72 and bottom valve 23 to prevent leakage to the wellbore. Additional force by the wireline releases the bit/shank latch 26 and the coring tool is pulled out of the well.

Figure 8:
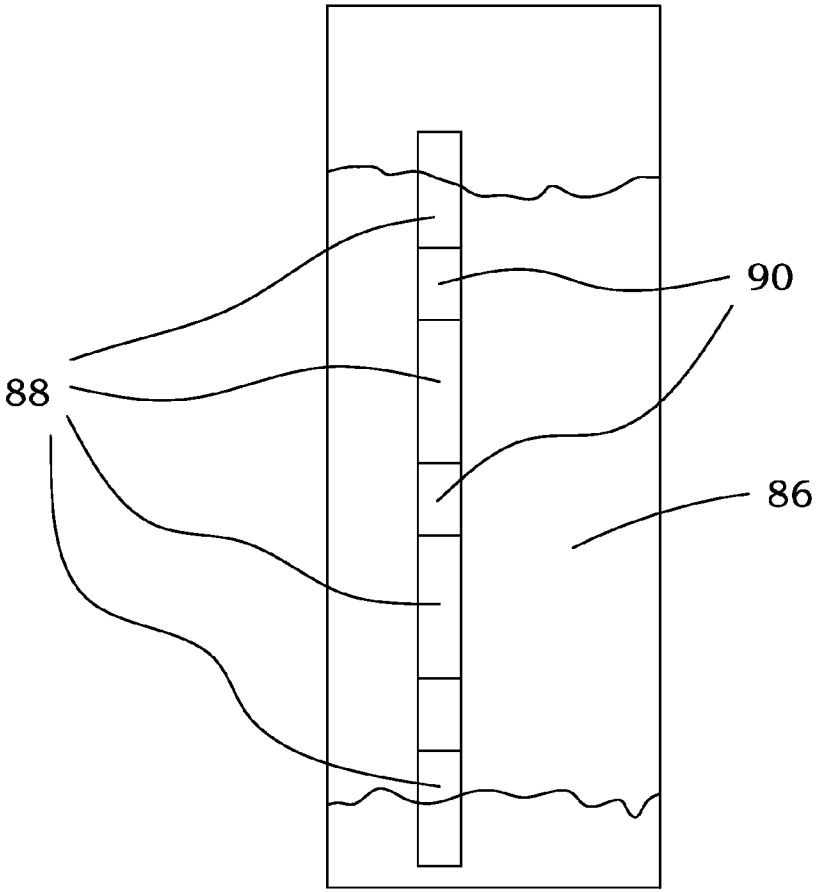
FIG. 8 is an elevational view, in section, showing an overview of an underground pay zone with a proposed coring program in accord with one possible embodiment of the present invention.

FIG. 8 shows one embodiment of a program for coring underground zone of interest 86. In this embodiment, four 27 meter (90 feet) 3" standard wire line cores 88 are taken and three 3 meter (10 feet) 3" inch pressure cores 90 are taken. Accordingly, a good sample of core pressures and fluids is provided to make calculations. As well, the actual formation matrix over the entire zone is provided.

Figure 9:
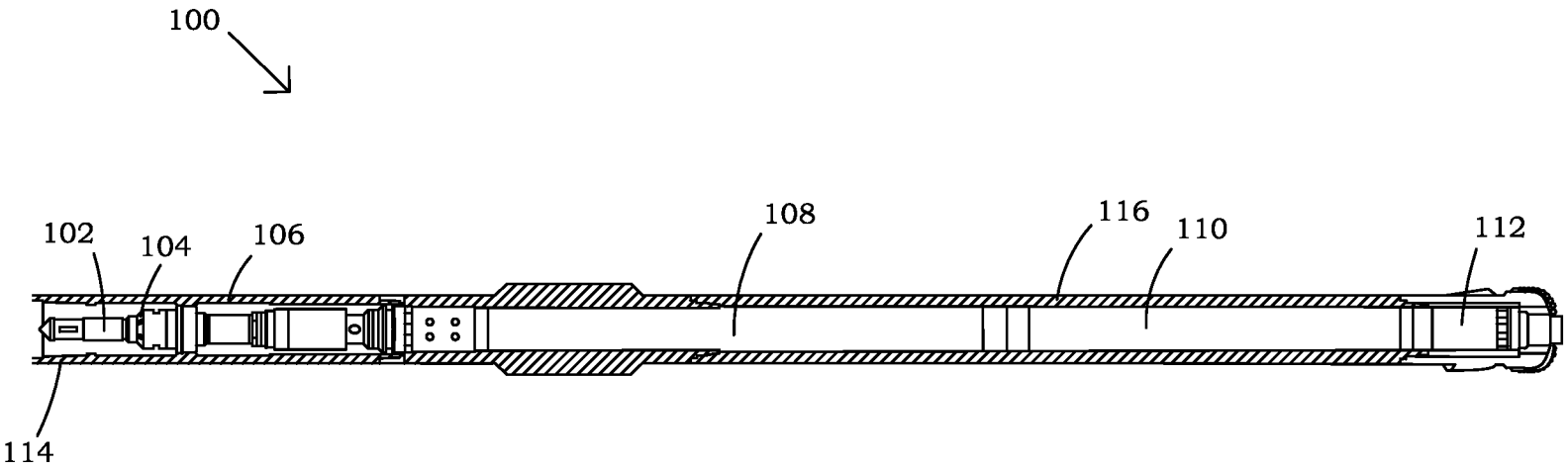
FIG. 9 is an elevational schematical view showing another possible embodiment of a coring tool in accord with one possible embodiment of the present invention.
Figure 10:
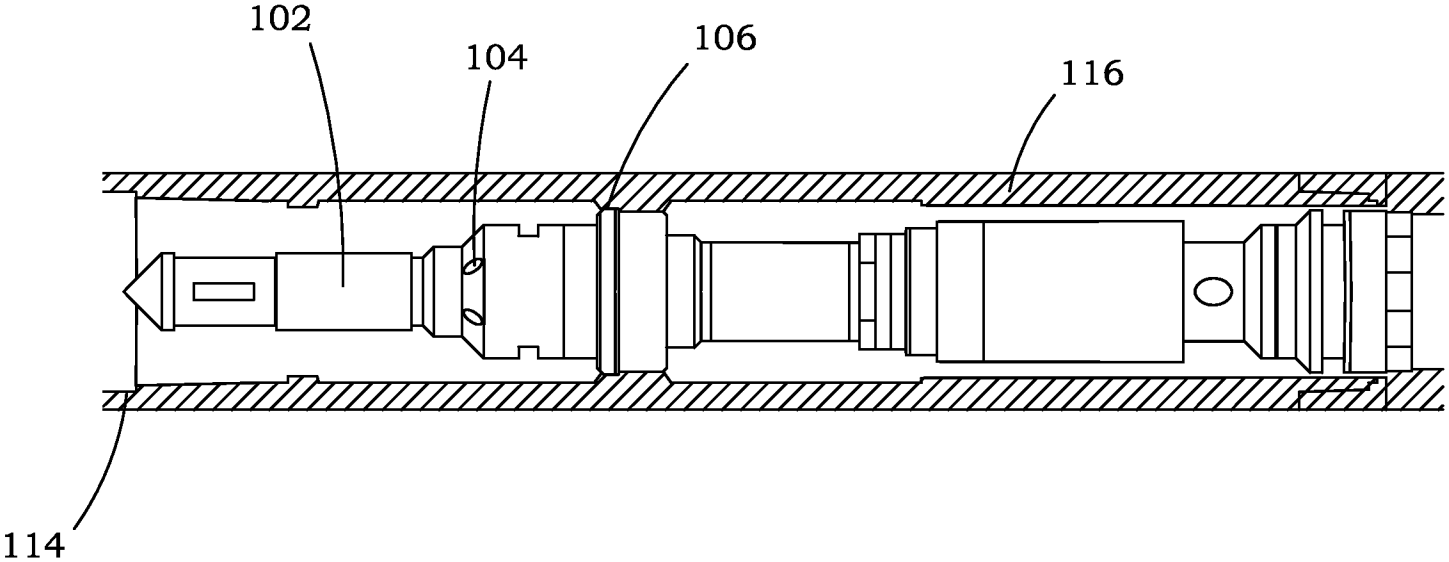
FIG. 10 is an elevational view that is an enlarged upper section of FIG. 9 showing a swivel section of a coring tool in accord with one possible embodiment of the present invention.

FIG. 9 shows coring tool 100, which is another possible embodiment of the present invention. In FIG. 9 and FIG. 10, fishing neck 102 is provided at the top of the retrievable portion of coring tool 10 to provide an overshot connection for retrieving the core. Flow nozzles 104 may or may not be utilized for fluidly latching the coring tool into position and/or or other purposes as is known in the art. Landing seat 106 is provided as a shoulder which supports the wireline retrievable portion of coring tool 100 in the desired axial position with respect to outer barrel 116. Threads 114 may be utilized for securing coring tool 100 to the drill pipe or the like.

Figure 11A:
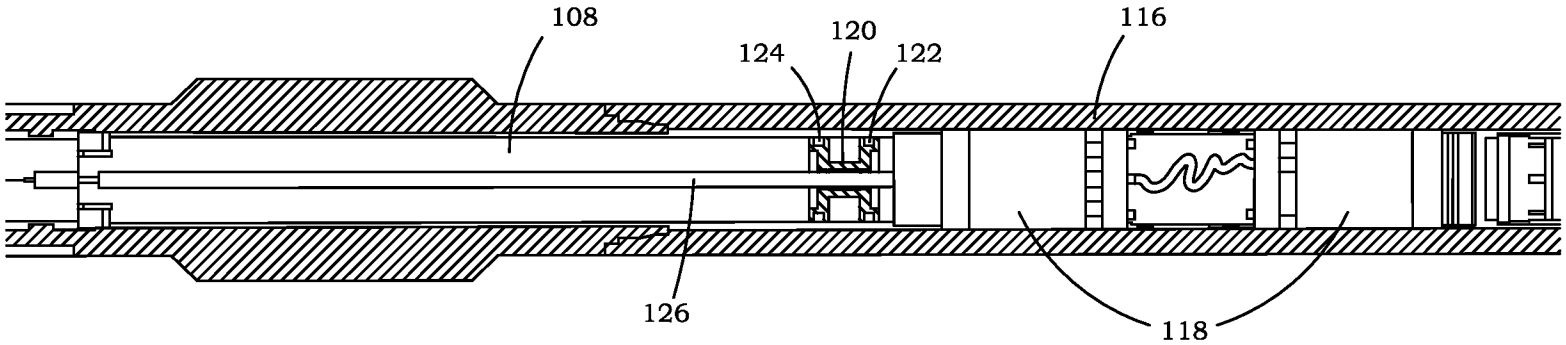
FIG. 11A is an elevational view that is an enlarged middle section of FIG. 9 showing a fluid canister section of a coring tool in accord with one possible embodiment of the present invention.

FIG. 9 and FIG. 11A show another embodiment of gas storage canister 108 and/or other canisters, which may be utilized to store the reduced pressure gas from the core as discussed generally hereinbefore. In one possible embodiment, gas storage canister 108 may be removed from the tool and transported to the lab for analysis and/or be analyzed with an onsite lab. In one possible embodiment, one or more pressure/temperature recording modules 118 may be utilized to monitor pressure, temperature, time, and/or other variables within the inner barrel and/or pressure canister and/or the wellbore. FIG. 11A also shows piston 120, with upper and lower seals 124 and 122 as well as gas flow passageway 126.

Figure 11B:
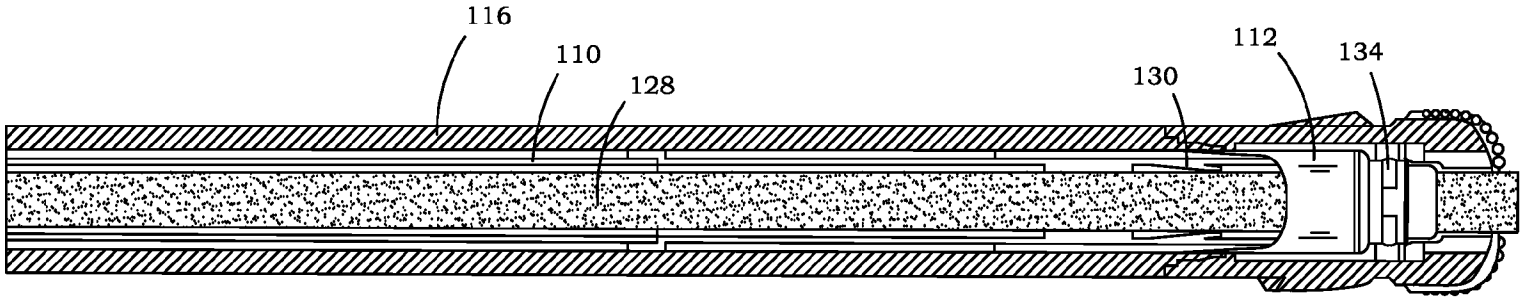
FIG. 11B is an elevational view that is an enlarged lower section of FIG. 9 showing a core barrel portion of a coring tool in accord with one possible embodiment of the present invention.

FIG. 9 and FIG. 11B show inner core barrel 110, which may be utilized to retrieve core 128. In one possible embodiment, outer barrel 116 contains inner core barrel 110, which may comprise relatively sliding members, concentrically or telescopingly arranged members and/or the like to allow the bottom of the core to be moved past bottom valve 136 in a manner similar to that discussed hereinbefore. In this embodiment, these members may be telescoping with respect to each other to allow the tool to "stroke" as described generally earlier and discussed hereinafter, during which time the core is moved away from and upwardly past bottom valve mechanism 112 prior to closing the valve. Core catcher 130 and bottom valve 112 (and valve actuator) are utilized to secure core within core barrel 110 and seal off the lower end of inner core barrel 110 when the core is retrieved. Bit/shank latch 134 is also provided to hold the bottom of the coring tool in position during stroking when the expandable tool is pulled upwardly by the wireline.

FIG. 12A, FIG. 12B, FIG. 12C, and FIG. 12D, shows the sequence of activating bottom valve 136 of coring tool 100. In this embodiment, the sliding or stroking operation of the tool is similar to that of the embodiment of FIG. 2A, FIG. 2B, FIG. 2C, and FIG. 2D for coring tool 10 during which time the core is moved past the bottom valve before closing. In this embodiment, a different bottom valve mechanism is utilized. However, it is to be understood that other types of bottom valves such as ball valves or the like may be utilized more reliably due to the stroking function whereby the bottom of the core moves out of the way of the moveable members of the bottom valve before the valve closes.

Figure 12A:
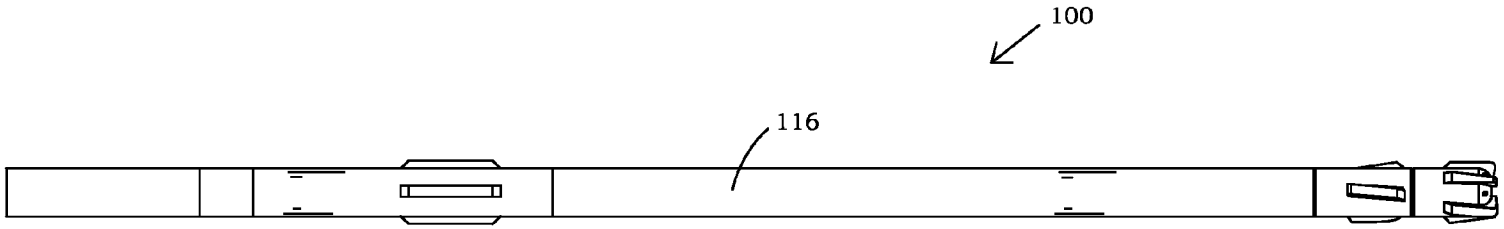
FIG. 12A is an elevational view that is an outer view of a coring tool prior to stroking the tool to move the bottom of the core above the bottom valve in accord with one possible embodiment of the present invention.
Figure 12B:
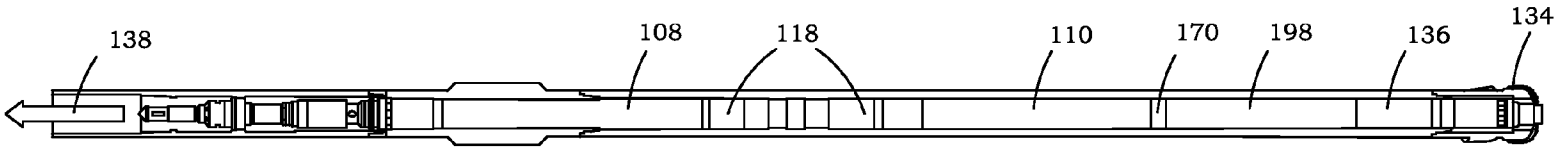
FIG. 12B is an elevational view, partially cutaway, of a coring tool prior to stroking the tool to move the bottom of the core above the bottom valve in accord with one possible embodiment of the present invention.
Figure 12C:
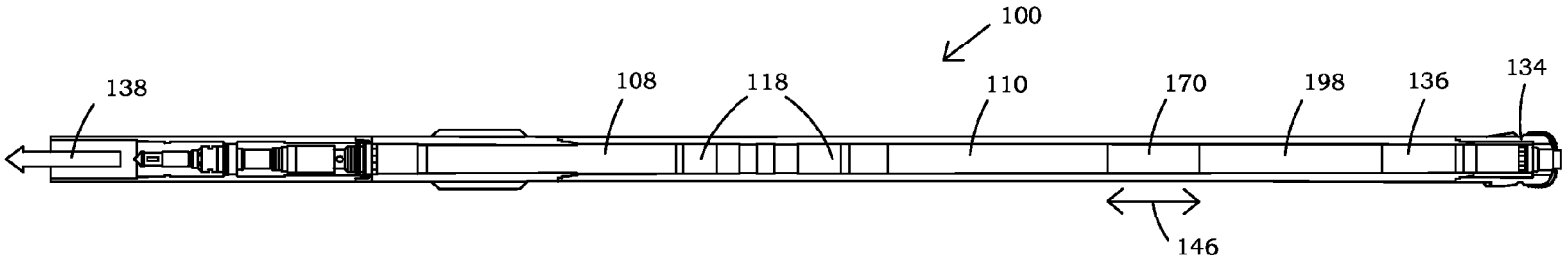
FIG. 12C is an elevational view, partially cutaway, of a coring tool in an initial stage of stroking the tool to move the bottom of the core above the bottom valve in accord with one possible embodiment of the present invention.
Figure 12D:
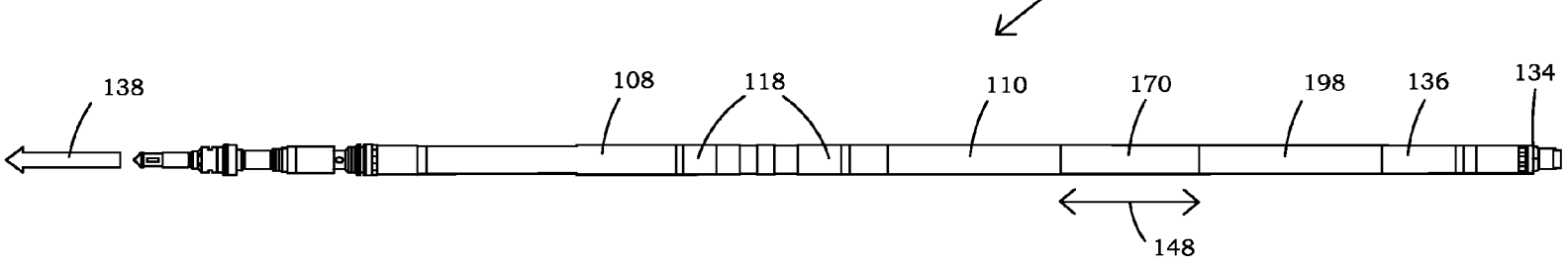
FIG. 12D is an elevational view, partially cutaway, of a coring tool in an initial stage of stroking the tool to move the bottom of the core above the bottom valve in accord with one possible embodiment of the present invention.

FIG. 12A shows an external view of coring tool 100. In FIG. 12B, the wireline is run down and latched to the top of the retrievable portion of coring tool 100. An up hole directed force is produced as indicated by upwardly drawn arrow 138. In this embodiment, core catcher mandrel 170 is telescopingly or concentrically mounted and sealed within sealing tube 198, which also seals around the body of bottom valve 136. In FIG. 12C, the tool begins to stroke to allow the core to move past bottom valve 136, whereby core catcher mandrel 170 is telescopingly, concentrically and/or sliding partially pulled out of sealing tube 198 or stroked as indicated by distance arrow 146. The relatively sliding members, as discussed hereinafter, may be utilized to produce a tool stroking effect as discussed earlier with respect to the valve actuator shown in FIG. 6A and FIG. 7A. During this process, the axial length of the inner barrel is expanded or increased.

In one possible embodiment, bit/shank latch 134 remains engaged throughout this process. After coring tool is fully stroked as indicated by distance 148, then force is exerted on bit/shank latch 134 to thereby release bit/shank latch 134. When full stroking is distance 148, then stops or shoulders between sealing tube 198 and core catcher mandrel 170 engage to prevent further expansion. In one embodiment, sealing tube is secured to bottom valve 136. At this time, upwardly directed force 138 is applied to bit/shank latch 134 to release bit/shank latch 134 and allow coring tool 100 (except for the outer barrel components) to be pulled out of the borehole, with inner barrel 110 sealed off at the bottom end thereof by bottom valve 136. In one embodiment, the expanded inner barrel length or stroking distance 148 may be in the range between one and two feet or somewhat more or less as desired. In one embodiment, distance 148 may be twenty inches plus or minus twelve inches or plus or minus six inches or somewhat more or less as desired for reliable operation of bottom valve 136 after the bottom of the core passes therethrough, as discussed hereinbefore and/or hereinafter.

Figure 13A:
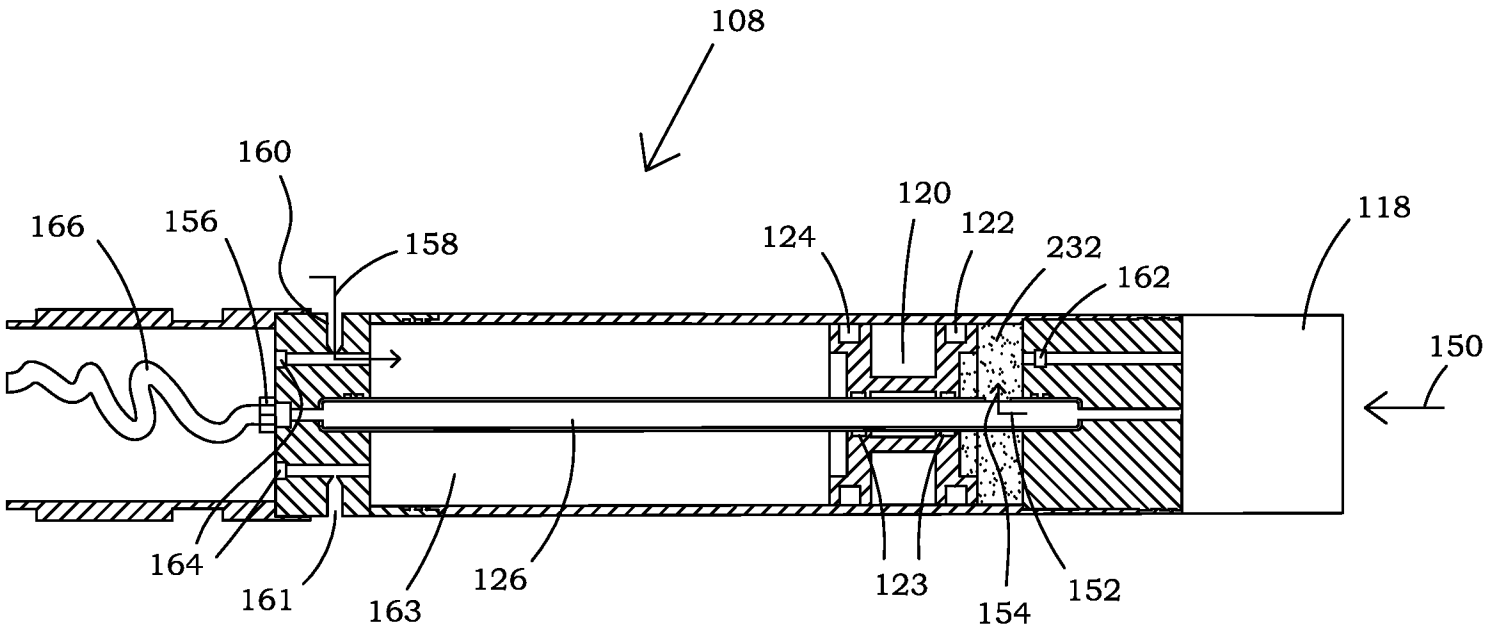
FIG. 13A is an elevational view, in section, showing the pressure canister operation in an initial stage of operation as the coring tool ascends as the wireline or drill pipe tool pulls the inner coring tool up the borehole so that the well bore drilling fluid pressure decreases in accord with one possible embodiment of the present invention.

As the inner barrel is pulled out of the hold, the fluid canister begins to operate as discussed hereinbefore. FIG. 13A shows another possible embodiment of fluid storage canister 108. In this embodiment sealed core pressure is applied to one end of fluid storage canister 108 as indicated at arrow 150. In one embodiment, this pressure overcomes a lower relief valve, which may be a one-way valve, as the tool moves towards the lower well bore drilling fluid pressure at the surface. The relief valve activation pressure may be set at 500 psi, plus or minus a range of 50 to 500 psi or more or less, as discussed hereinbefore. In another embodiment a one-way valve may be utilized to seal the bottom of fluid canister 108 for retrieval purposes as discussed hereinafter. The desire is to have a relatively safe working pressure at the surface. As discussed hereinbefore, piston 120 is sealed at the interior side by inner seals 123, which seal around tube 126. Outer upper seal 124 and outer lower seal 122 seal around the circumference of piston 120.

Once the relief valve pressure is overcome, assuming a relief valve is utilized, then core fluids 232 such as gas/liquid flow from the core into opening 152 in fluid flow passageway tube 126 (or another tube if desired) at the lower side of piston 120 as indicated by core pressure fluid flow arrow 154. The other end of fluid flow passageway tube 126 is closed utilizing upper relief valve 156, which may be set to a desired relief valve pressure operation the same as or higher than the lower relief valve and/or one way valve.

As discussed hereinbefore, the core fluid pressure as indicated by arrow 154 may be offset by well bore drilling fluid pressure as indicated by arrow 158 or a derivative thereof, which may flow through wellbore opening 160 into upper chamber 163 of gas storage canister 108 and is applied at the upper side of piston 120. Additional wellbore openings 161 from the wellbore into upper chamber 163 of gas storage canister may be utilized, if desired.

Pressure and temperature of the inner barrel and/or one or more canisters and/or wellbore fluids, and other desired measurable parameters, may be monitored by various sensors such as temperature/pressure sensor 162 and recorded by recording module 118. Plugs and/or other sensors 164 may be utilized to seal and/or measure well bore drilling fluid pressure/temperature and/or other parameters. Pressure hose 166 may lead to another recording module and/or another gas storage canister, as discussed hereinbefore.

Figure 13B:
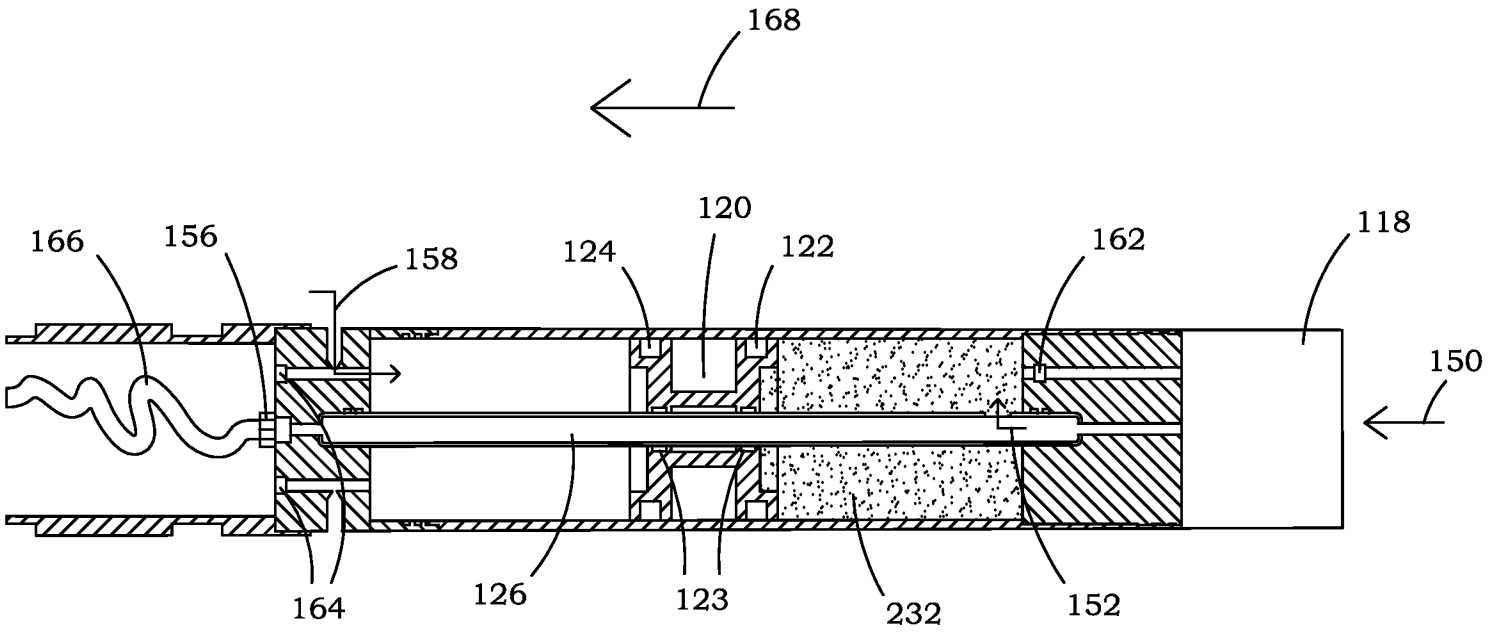
FIG. 13B is an elevational view, in section, showing the pressure canister operation as the wireline or drill pipe tool pulls the inner coring tool up the borehole so that the well bore drilling fluid pressure decreases, thereby increasing the differential between the canister and the core in the inner barrel until the relief valve opens to thereby collect fluid (liquid and gas) from the core into the canister, which operates a piston in the canister, in accord with one possible embodiment of the present invention.

In FIG. 13B, as the gas storage canisters are pulled out of the hole toward the surface, well bore drilling fluid pressure 158 decreases. Accordingly, the volume of core fluid 232 expands as the core fluid pressure 152 causes piston 120 to move in the direction indicated by arrow 168, which in one possible embodiment is up hole towards the top of the tool. Accordingly, an expandable chamber is provided to receive fluid from the core.

Figure 13C:
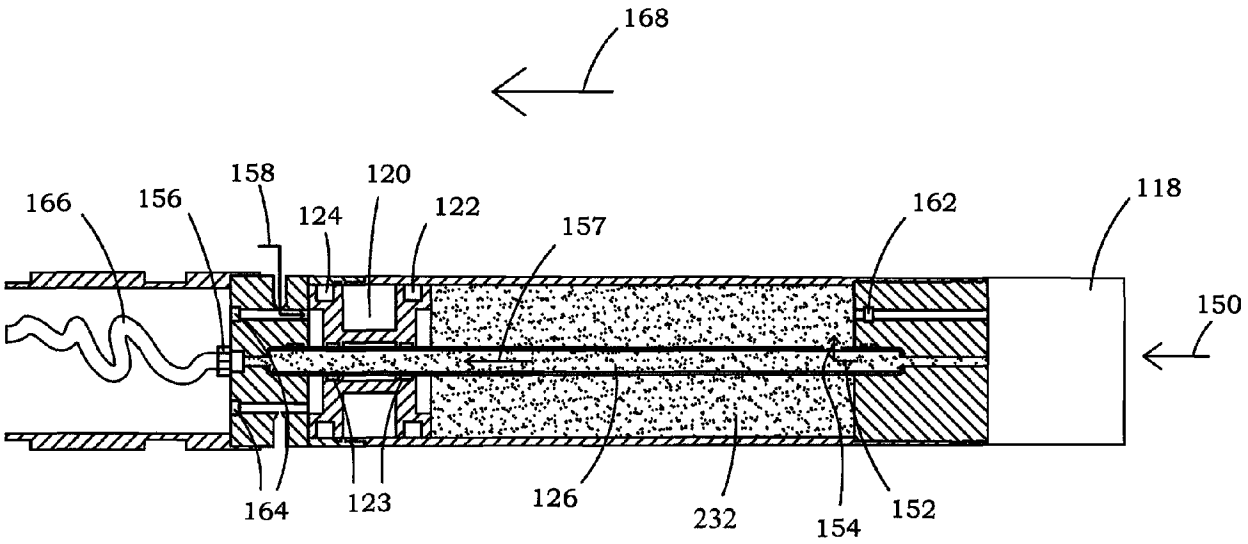
FIG. 13C is an elevational view, in section, showing the pressure canister operation as the wireline or drill pipe tool pulls the inner coring tool up the borehole so that as the well bore drilling fluid pressure decreases the fluid (gas and liquids) from the core fill the canister, pushes the canister piston until the canister piston blocks the well bore pressure vent, whereby the second relief valve of the second canister is now subject to differential pressure changes, and upon reaching the desired differential pressure, the second relief valve opens to allow fluid flow into the second canister (and likewise additional canisters) to collect fluid and gas from the core in multiple canisters in accord with one possible embodiment of the present invention.

As shown in FIG. 13C, once piston 120 reaches the end of the chamber of gas storage canister, the differential pressure between continuously dropping well bore drilling fluid pressure and sealed core pressure increases as discussed hereinbefore until upper relief valve 156 opens. The core fluid 232 and pressure then goes through gas flow passageway 126 as indicated by arrow 157 and pressure hose 166 as the core pressure escapes into the next canister and the process repeats itself.

Figure 14A:
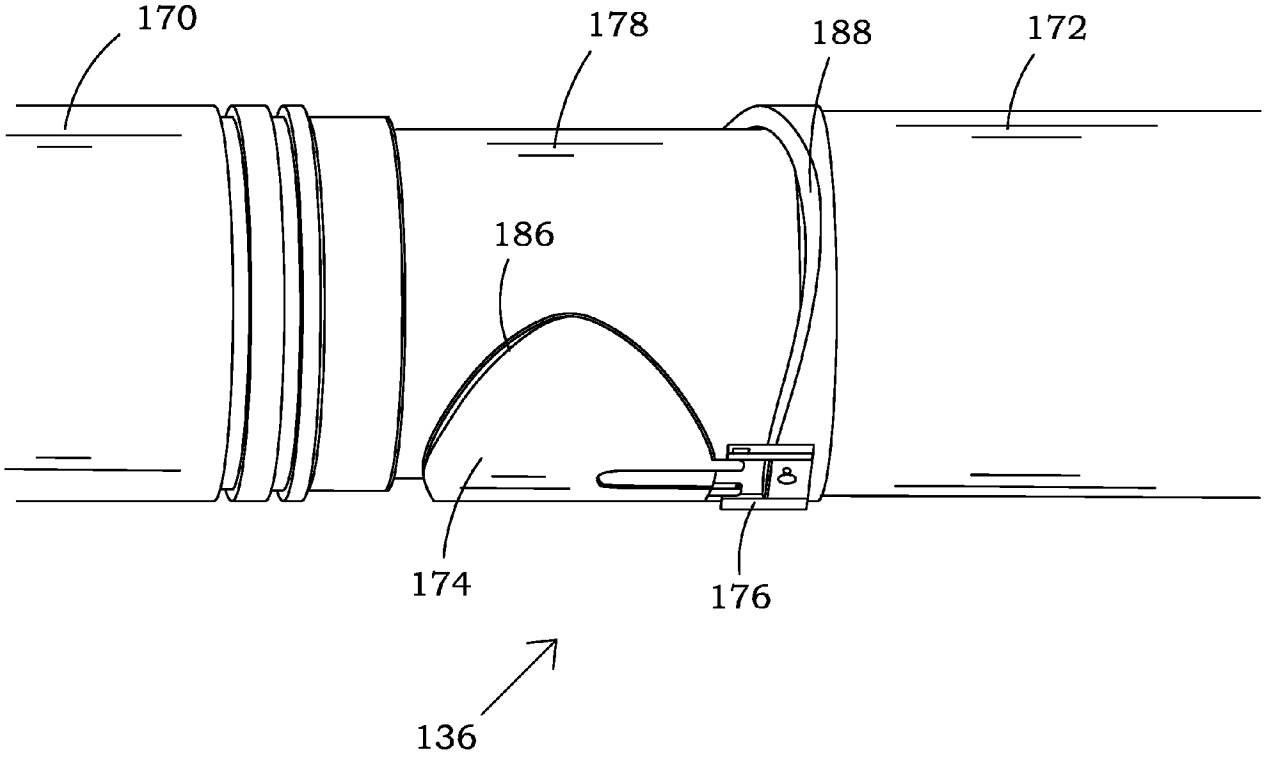
FIG. 14A is an elevational view showing a bottom valve for a coring tool in accord with one possible embodiment of the present invention.
Figure 14B:
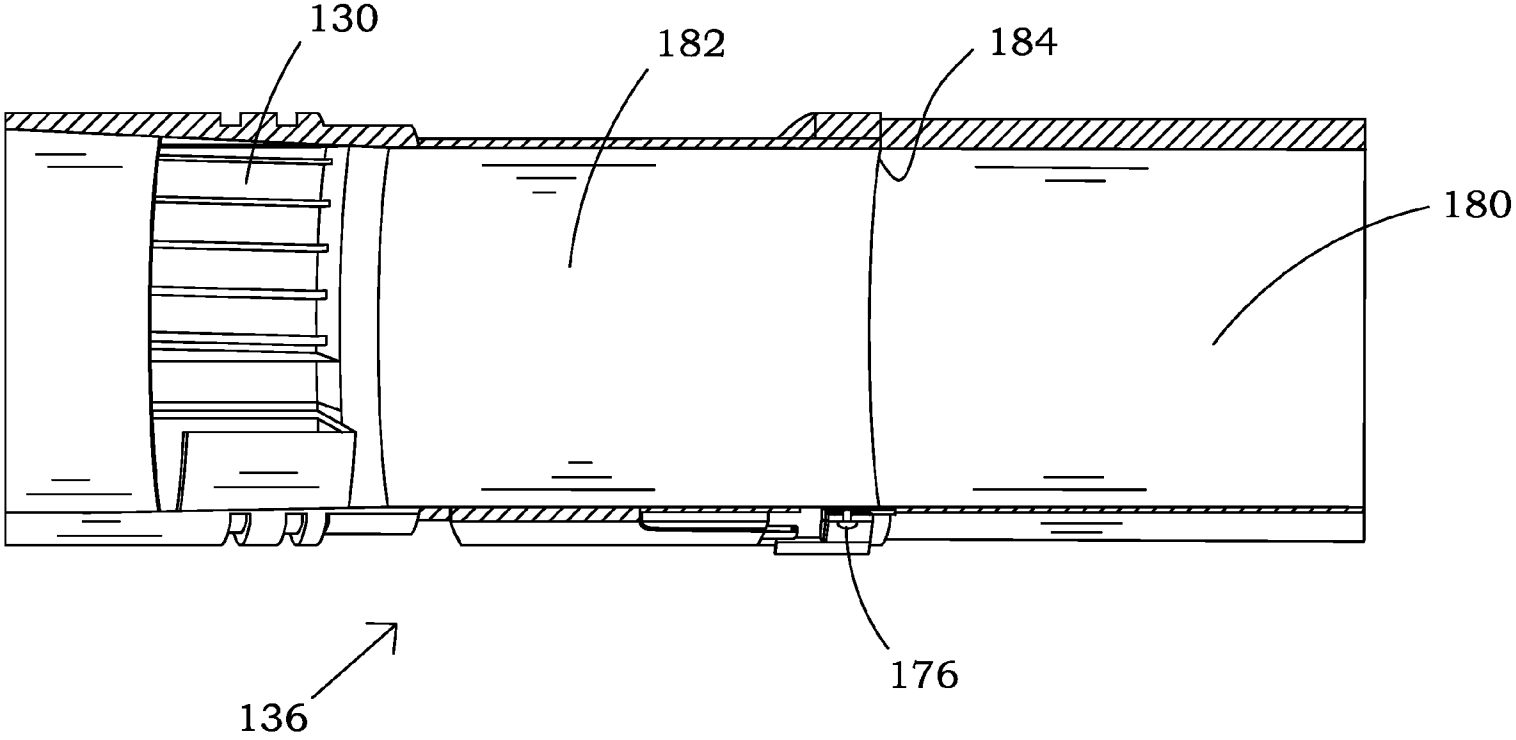
FIG. 14B is an elevational view, partially in section showing a bottom valve for a coring tool in accord with one possible embodiment of the present invention.

FIG. 14A and FIG. 14B show another possible embodiment of bottom valve 136, which in this embodiment utilizes core catcher mandrel 170 and core float seal body 172. Outer sealing tube 198, which telescopingly seals around core catcher mandrel 170 and also seals around core float seal body 172 is removed for easier viewing.

In FIG. 14A, flapper valve element 174 is pivotally attached to core float seal body 172 with spring-loaded hinge 176. The inner surface of flapper valve element 174 is cylindrical and mates with the outer surface of catcher mandrel lower tube 178 to protect flapper valve element 174 from damage.

In FIG. 14B, which is partially shown in cross-section, it can be seen that lower tube 178 slidingly and/or telescopingly extends into bore 180 of core float seal body 172 and in this embodiment may seat at shoulder 184. Bore 180 and bore 182 may preferably be the same internal diameter and in combination form a smooth unrestricted bore for receipt of core 128.

Flapper valve element 174 has a contour at periphery 186, which mates to a contour at top sealing surface 188 of core float seal body 172. The periphery of flapper valve 174 and/or top sealing surface 188 may comprise high temperature/pressure sealing material, such as elastomeric material, bonded rubber, metallic rib/groove metallic seals, soft material seals, other metal seals, or other types of seals. In this embodiment, the mating contour is rounded. It will be appreciated that considerable sealing force will result on flapper valve element 174 to hold flapper valve element 174 against top sealing surface 188 because the pressure in catcher mandrel is maintained at about 500 psi relative to atmospheric pressure, as discussed hereinbefore, and the diameter of the core may be in the range of about three inches.

Figure 15A:
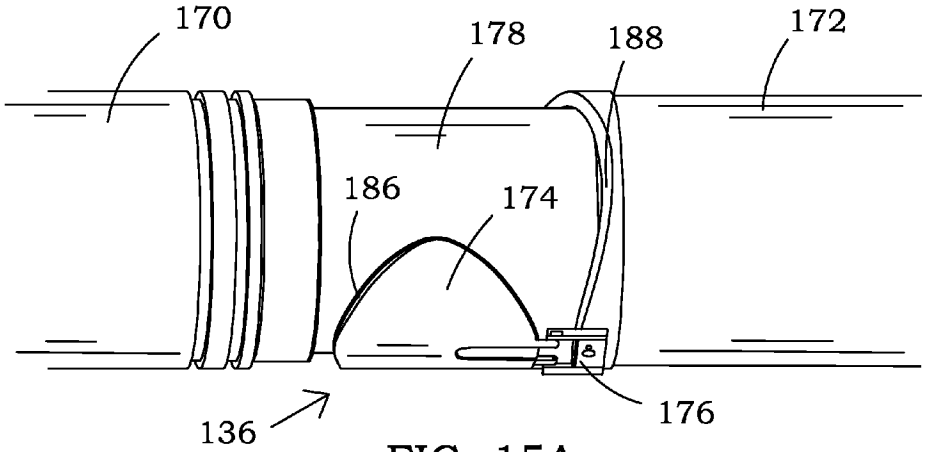
FIG. 15A is an elevational view showing a bottom valve for a coring tool prior to stroking the tool to move the bottom of the core past the bottom valve in accord with one possible embodiment of the present invention.

FIG. 15A, FIG. 15B, FIG. 15C, and FIG. 15D show the steps of bottom valve 136 activation. In FIG. 15A, the bottom valve is in the position shown in FIG. 14A with flapper element 174 held open by the outer surface of catcher mandrel lower tube 178. Stroking has not started as shown in FIG. 12B. However, assuming that the coring is completed, the core may then be broken.

Figure 15B:
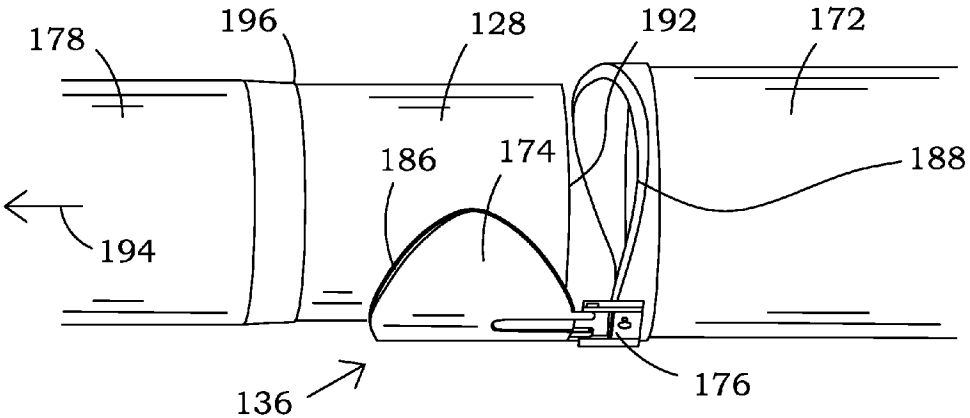
FIG. 15B is an elevational view showing a bottom valve for a coring tool in an initial stage of stroking the tool to move the bottom of the core past the bottom valve in accord with one possible embodiment of the present invention.

In FIG. 15B, force is applied with the overshot and wireline in the direction of the surface as indicated by wireline force direction arrow 194. Catcher mandrel lower tube 178 is removed from the bore 180 of core float seal body. Core 128, which may extend below the bottom end 196 of catcher mandrel lower tube 178 continues to hold flapper valve element 174 open. Additional means such as rod or extension of lower mandrel tube 178 may also be utilized to hold flapper valve element 174 open until the bottom end 192 of core 128 is reached.

Figure 15C:
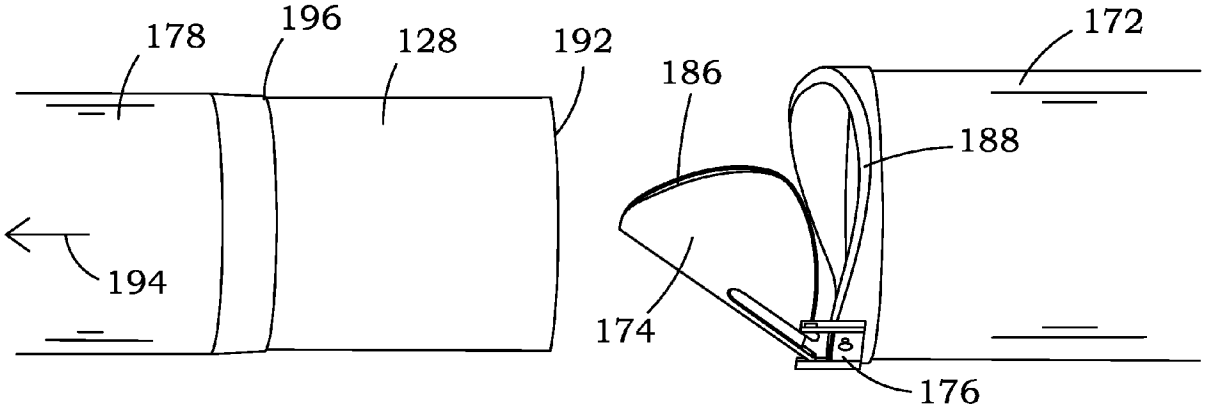
FIG. 15C is an elevational view showing a bottom valve for a coring tool which is closing after stroking the tool to move the bottom of the core past the bottom valve in accord with one possible embodiment of the present invention.

In FIG. 15C, bottom end 192 of core 128 moves out of the way of flapper element 174 so that spring-loaded hinge 176 helps close flapper element 174.

Figure 15D:
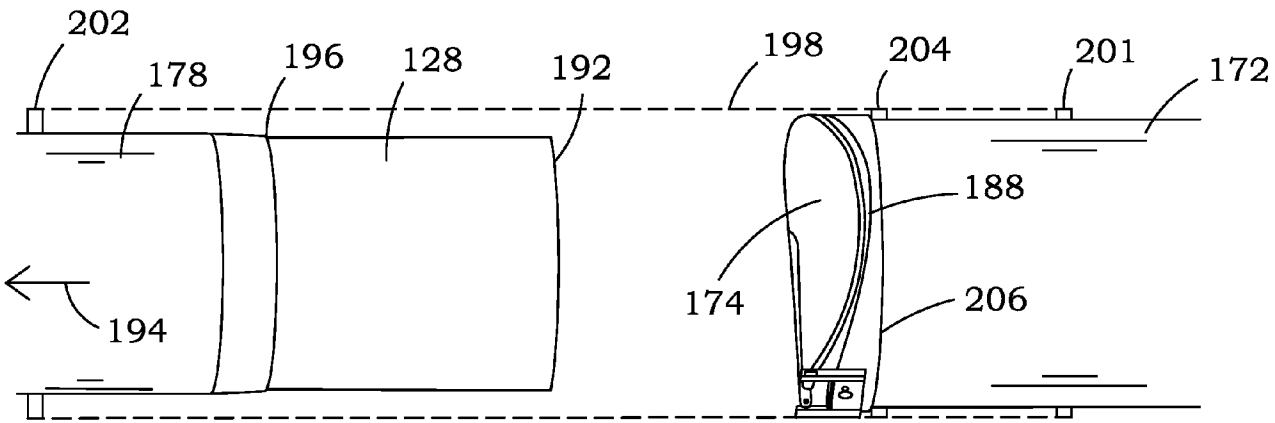
FIG. 15D is an elevational view, partially in dashed lines, showing a bottom valve for a coring tool closed after stroking the tool to move the bottom of the core past the bottom valve in accord with one possible embodiment of the present invention.

In FIG. 15D, flapper element 174 engages top sealing surface 188 of core float seal body 172, which seals off the bottom of the core barrel. The force on flapper element 174 increases to tighten the seal even more as the coring tool is pulled out of the hole by wireline or conventionally tripped by drill pipe.

In one possible embodiment, sealing tube 198 (See also FIG. 12 B and FIG. 16A), as indicated by dashed lines in FIG. 15D, surrounds and seals off core catcher mandrel 170 and core float seal body 172. Seals, such as seals 201 and 202 may be utilized. As well, stops such as stop 204 and shoulder 206 may be utilized. In one embodiment core catcher mandrel 170 slidingly and sealingly telescopingly engages sealing tube 198 (see also FIG. 16A) over the stroke length of the tool until a stop, shoulder or the like is engaged between tube 198 and core catcher mandrel 170 or other component of the core barrel as indicated as stop 208 in FIG. 16D and FIG. 18C. In other words, sealing tube 198 and core catcher mandrel 170 are slidingly moveable with each other for about twenty inches, or whatever stroke length 148 (See FIG. 12D) of the tool is. Once the stop between core catcher mandrel 170 and sealing tube 198 is engaged, then further upward force by the wireline applies force to release bit/shank latch 134 whereupon the coring tool is removed from the borehole.

Figure 16A:
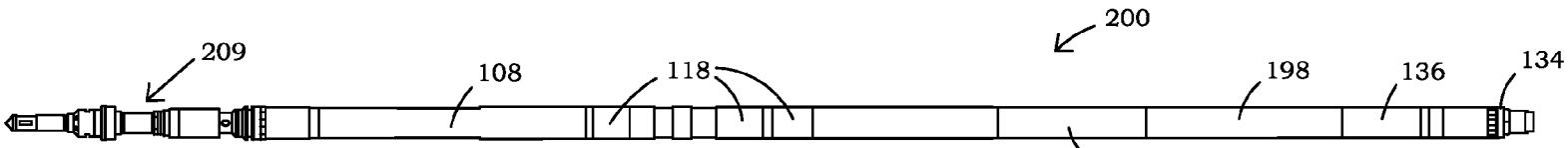
FIG. 16A is an elevational view showing the coring tool retrieved from the borehole prior to recovering the core in accord with one possible embodiment of the present invention.
Figure 16B:
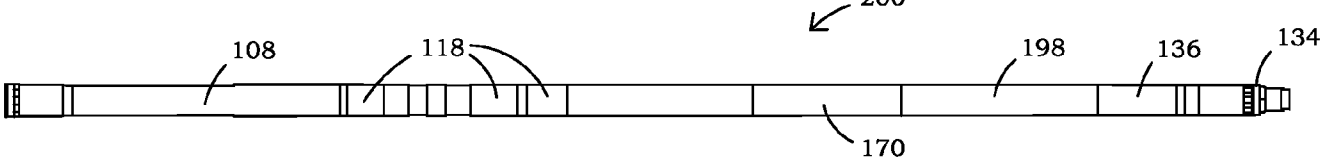
FIG. 16B is an elevational view showing the coring tool of FIG. 16A with the swivel section removed in accord with one possible embodiment of the present invention.
Figure 16C:
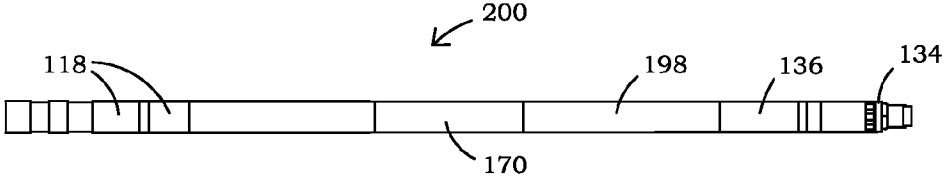
FIG. 16C is an elevational view showing the coring tool of FIG. 16A with the canister section removed in accord with one possible embodiment of the present invention.
Figure 16D:
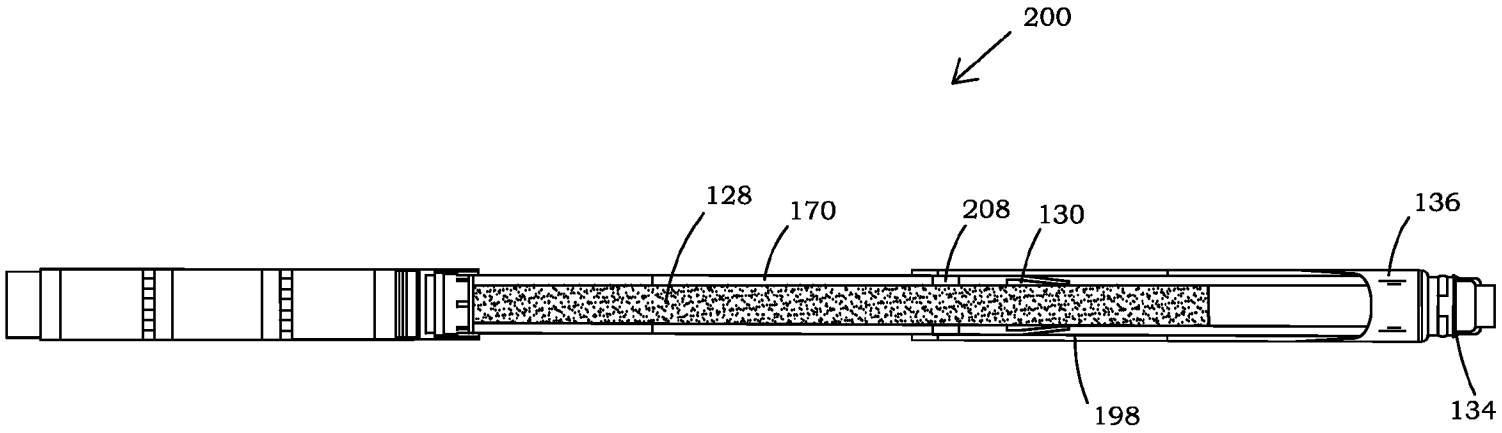
FIG. 16D is an elevational view, partially in section, showing the coring tool of FIG. 16C with the core therein in accord with one possible embodiment of the present invention.

FIG. 16A, FIG. 16B, FIG. 16C, and FIG. 16D show the core recovery process. In FIG. 16A, the tool is shown as removed from the wellbore. Swivel portion 209 is removed as indicated in FIG. 16B. Canisters 108 and associated recording modules 118 are removed, essentially leaving inner core barrel 200 as shown in FIG. 16C. FIG. 16D, partially in section, shows sealing tube 198 containing the core within core inner barrel 200.

Figure 17A:
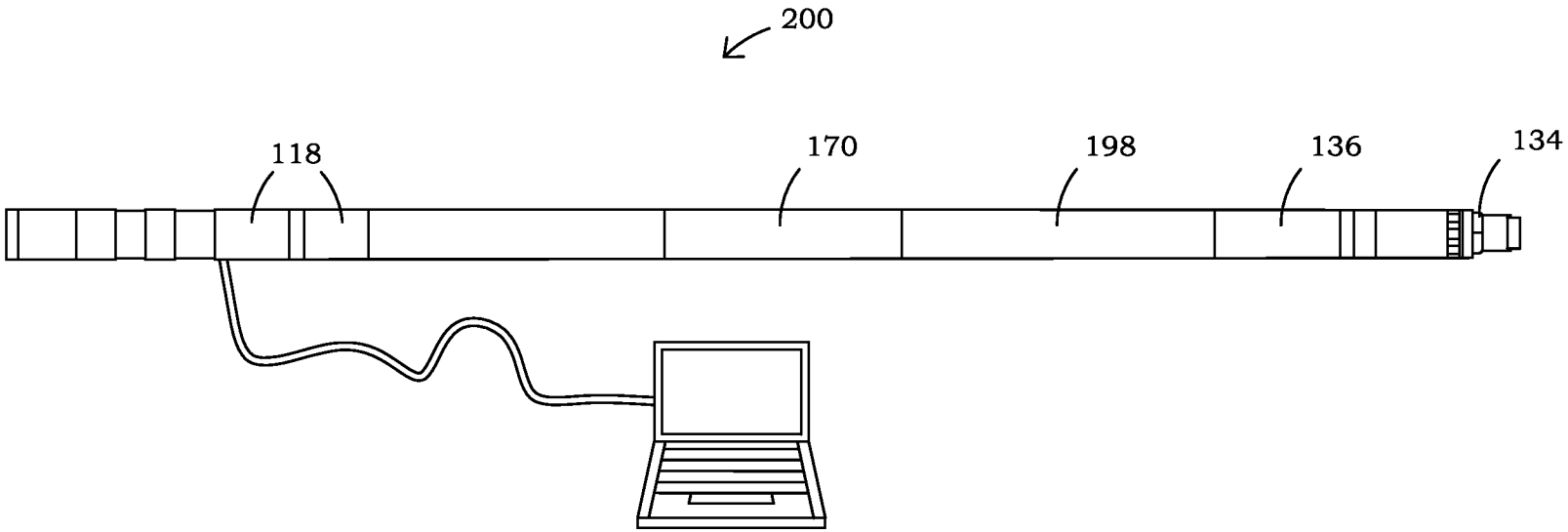
FIG. 17A is an elevational view showing the coring tool of FIG. 16C with an electronic connection to retrieve pressure and temperature data from a recording module in accord with one possible embodiment of the present invention.

As suggested in FIG. 17A, the recorded temperature and pressure within core barrel 200 is downloaded from the electronics within recording module 118 via electrical cable 210 to computer 212. Other means for obtaining this electronic information might also be utilized such as removing memory sticks or the like.

Figure 17B:
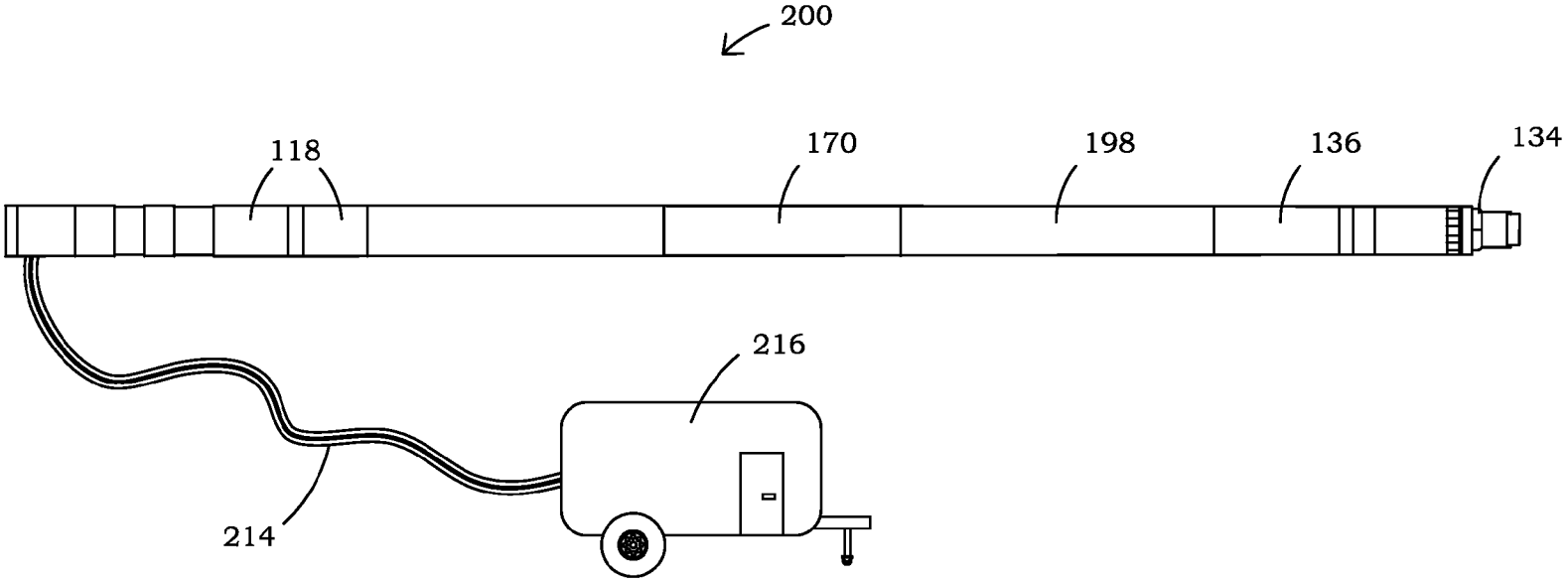
FIG. 17B is an elevational view showing the coring tool of FIG. 16C with pressure line connected to the core pressure to bleed off core gases in accord with one possible embodiment of the present invention.

In FIG. 17B, high pressure hose 214 is connected to the top of core barrel 200 and the core gasses are bled off and analyzed for volumes, desorption, compositions, pressures, and any other requested measurements, which may be performed within onsite laboratory 216, if desired, or taken to another laboratory.

Figure 18A:
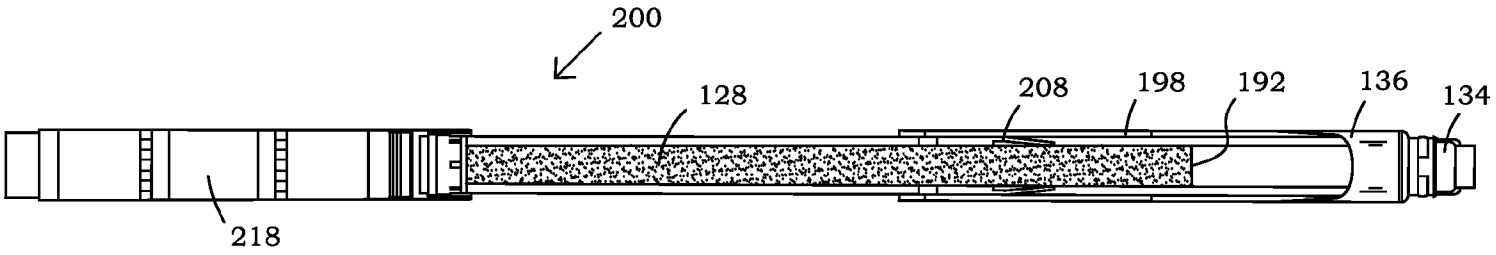
FIG. 18A is an elevational view, partially in section, showing the coring tool of FIG. 16C with pressure bled off prior to removing the core in accord with one possible embodiment of the present invention.
Figure 18B:
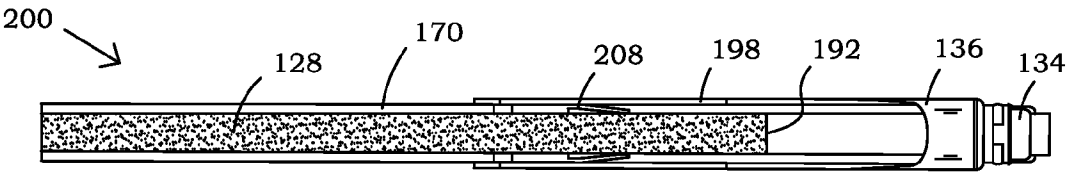
FIG. 18B is an elevational view, partially in section, showing the coring tool of FIG. 18A with the recording module removed prior to removing the core in accord with one possible embodiment of the present invention.
Figure 18C:
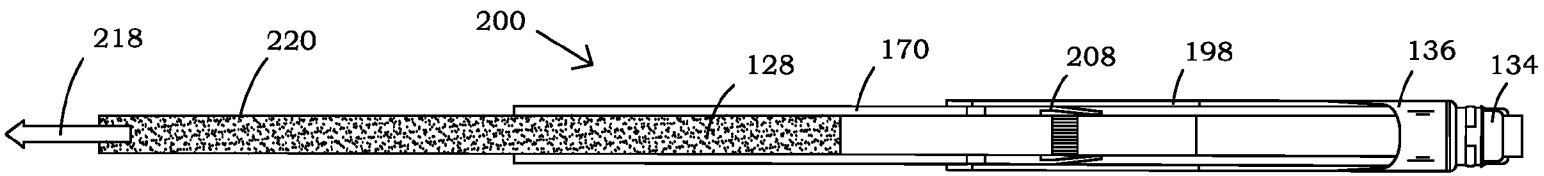
FIG. 18C is an elevational view, partially in section, showing the coring tool of FIG. 18B as the core is removed in accord with one possible embodiment of the present invention.

FIG. 18A shows a partial cross-section of core barrel 200 after the pressure is bled off. In FIG. 18B, electronics 218 are removed, thereby exposing core 128. Core 128 is then removed as indicated by direction arrow 218. Core 128 may be enclosed by an innermost barrel 220. Inner barrel 220 may comprise a highly perforated/slotted aluminum liner, solid steel liner, aluminum liner, variations of slotted liners, and the like as desired.

Figure 19A:
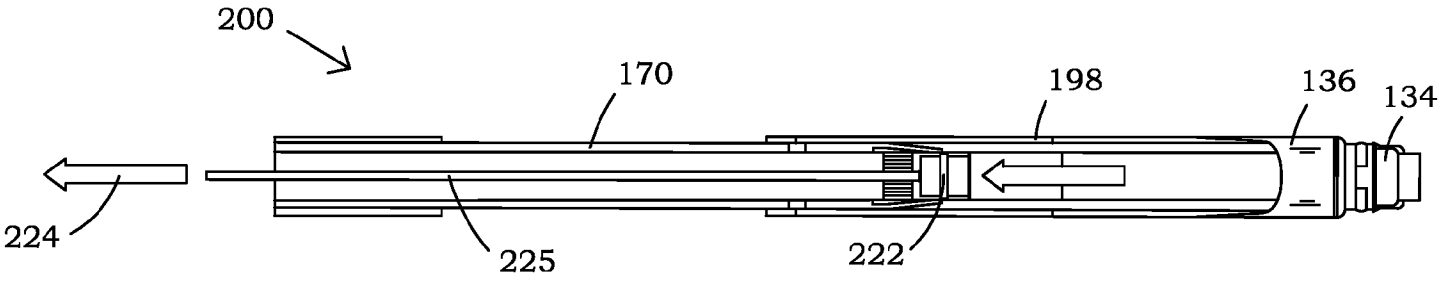
FIG. 19A is an elevational view, partially in section, showing a piston inserted into the tool after the core is removed to retrieve remaining fluid in accord with one possible embodiment of the present invention.
Figure 19B:
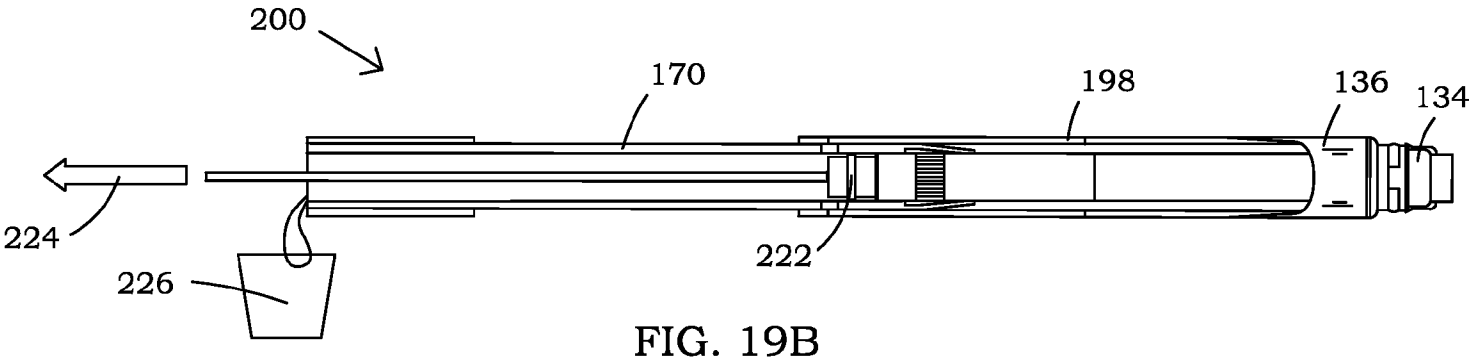
FIG. 19B is an elevational view, partially in section, showing the piston of FIG. 19A moved through the tool to retrieve fluid in accord with one possible embodiment of the present invention.
Figure 19C:
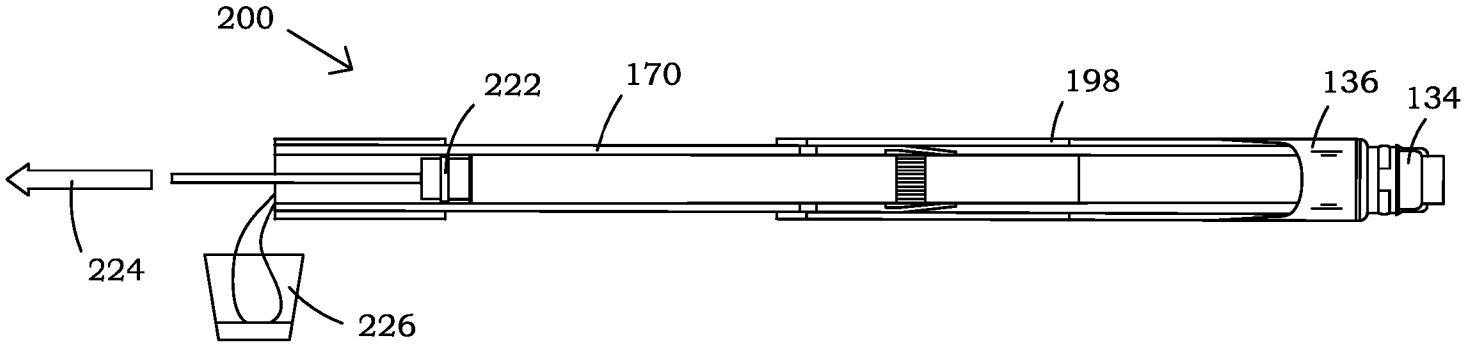
FIG. 19C is an elevational view, partially in section, showing the piston of FIG. 19A continuously moved through the tool to retrieve fluid in accord with one possible embodiment of the present invention.
Figure 19D:
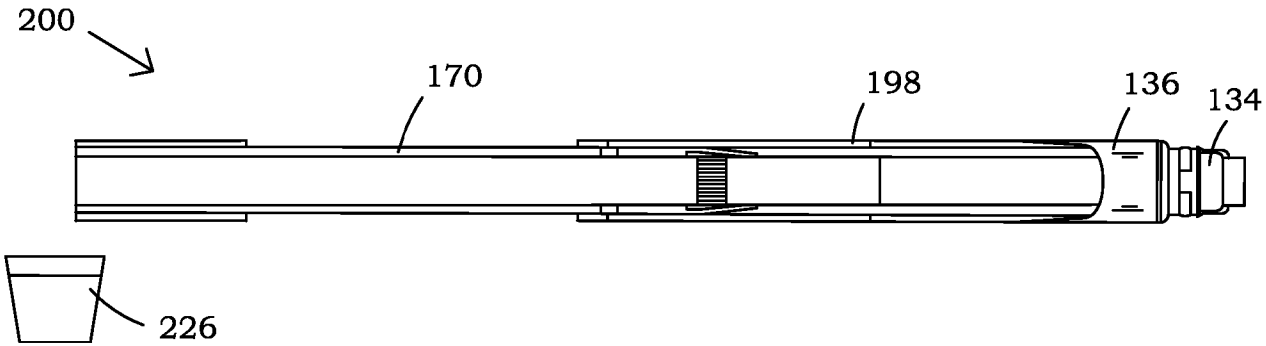
FIG. 19D is an elevational view, partially in section, showing the captured fluid remaining in the core barrel after removal of the core retrieved in accord with one possible embodiment of the present invention.

FIG. 19A shows remaining oil/liquid recovery from core barrel 200, if desired. Wiper rod 225 and piston 222 are inserted into core barrel 200 from the top of core barrel 200. Piston 222 is pulled through core barrel 200 as indicated by arrow 224 in FIGS. 19B, 19C, and 19D with the fluids being drained into container 226. The fluids are scraped off the internal surfaces of core barrel 200 to be collected, weighed, and analyzed. The same process may be repeated in reverse at the lower end of the tool after removing bottom valve assembly 136.

Figure 20A:
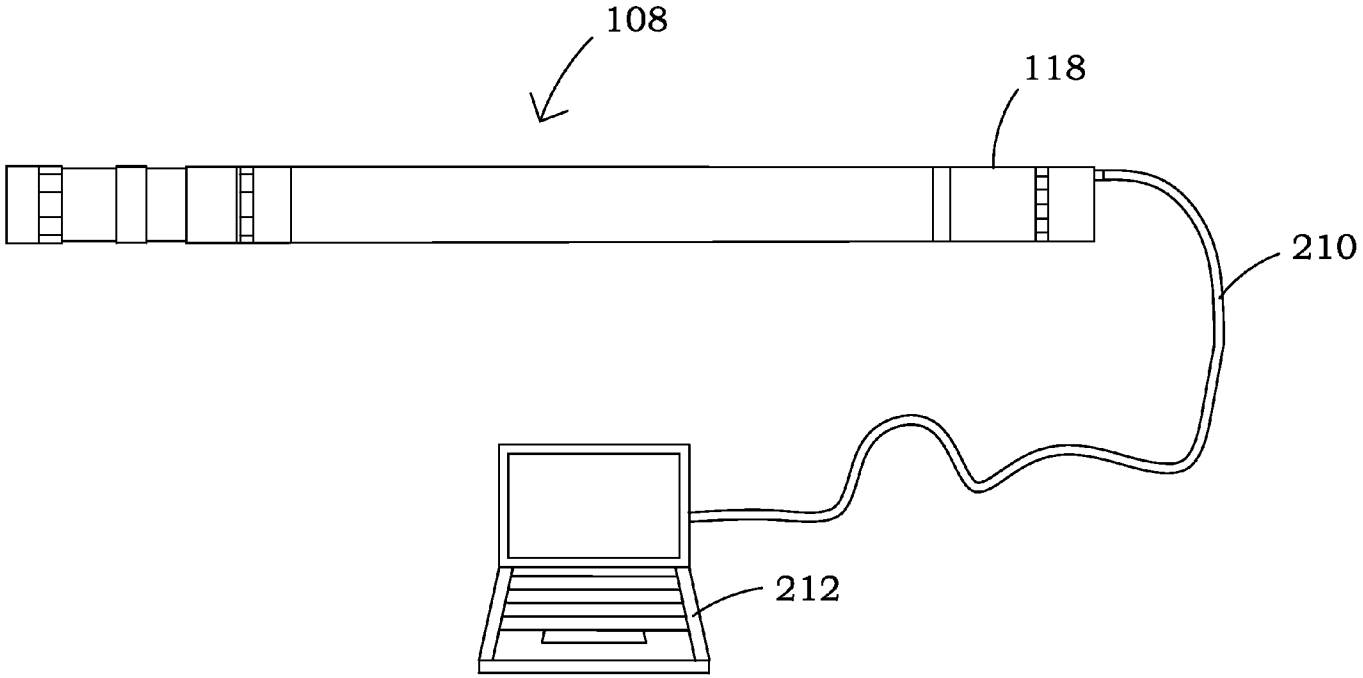
FIG. 20A is an elevational view showing the canister with an electronic connection to retrieve pressure and temperature data from a recording module in accord with one possible embodiment of the present invention.
Figure 20B:
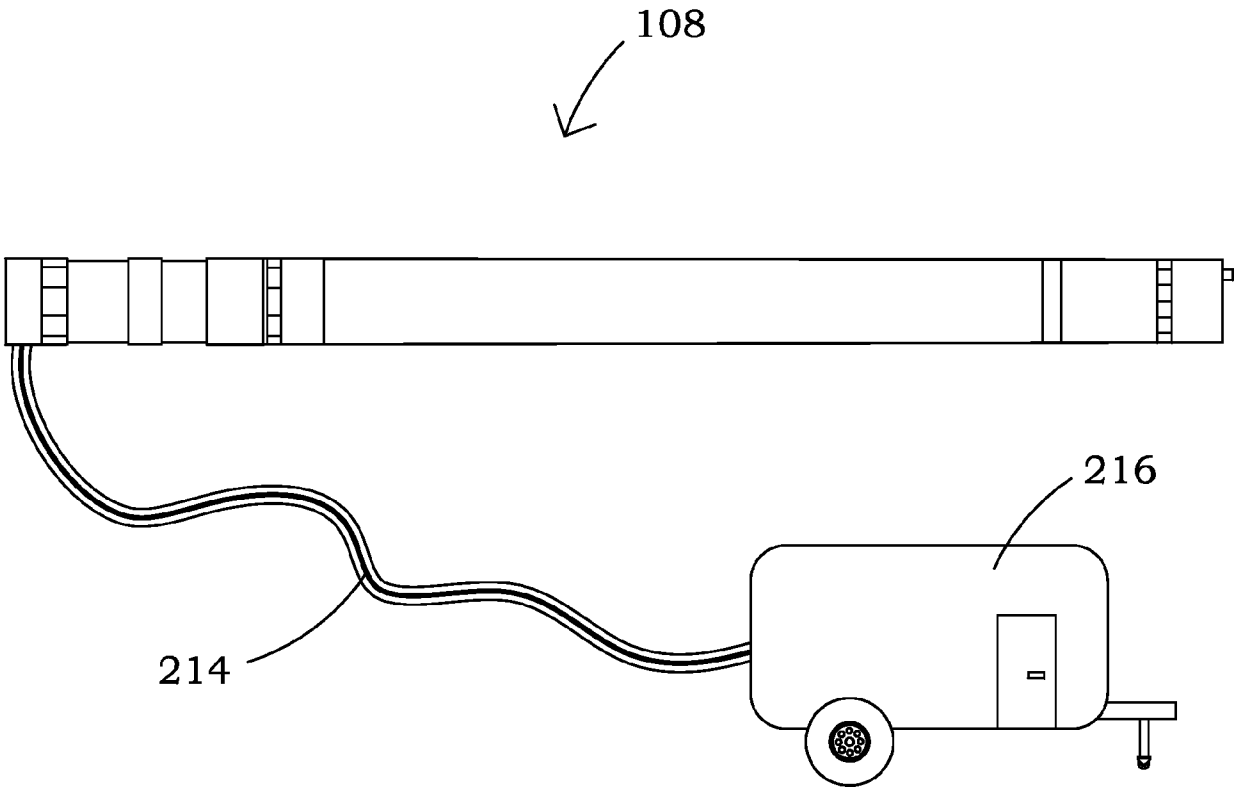
FIG. 20B is an elevational view showing the canister with a pressure hose connection to bleed off gas in accord with one possible embodiment of the present invention.

FIG. 20A shows the recovery process for fluid (gas and liquid) canister 108. Electrical cable 210 is connected to download recorded pressure and temperature data into computer 212 from recording module 118. In FIG. 20B, high pressure hose 214 may be connected to bleed off the gases, which may be analyzed for volumes, desorption, compositions, pressures, and the like in onsite laboratory 216, if desired.

Figure 20C:
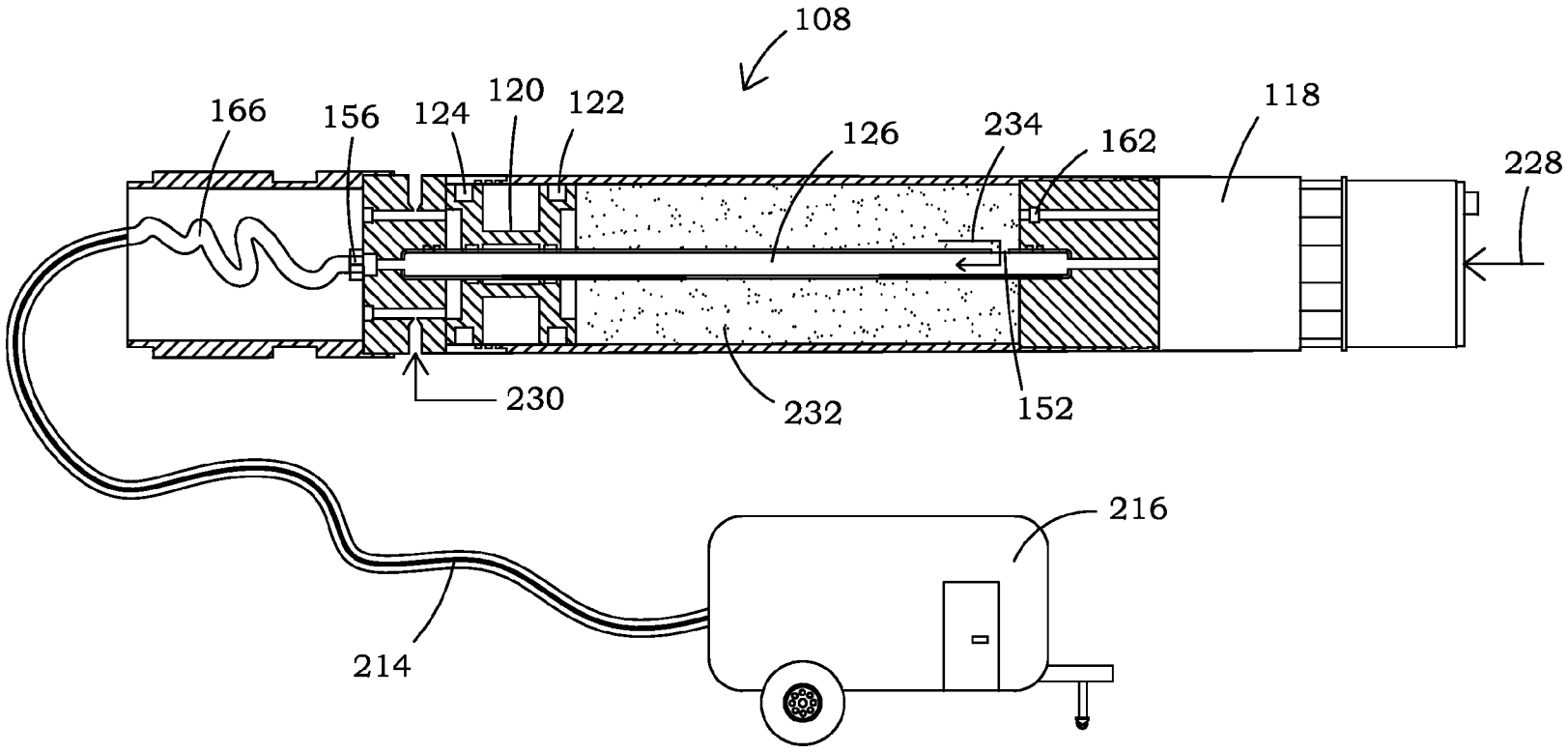
FIG. 20C is an elevational view, partially in section, showing the canister with a pressure hose connection to retrieve the recovered fluids in the initial stage of recovery in accord with one possible embodiment of the present invention.
Figure 20D:
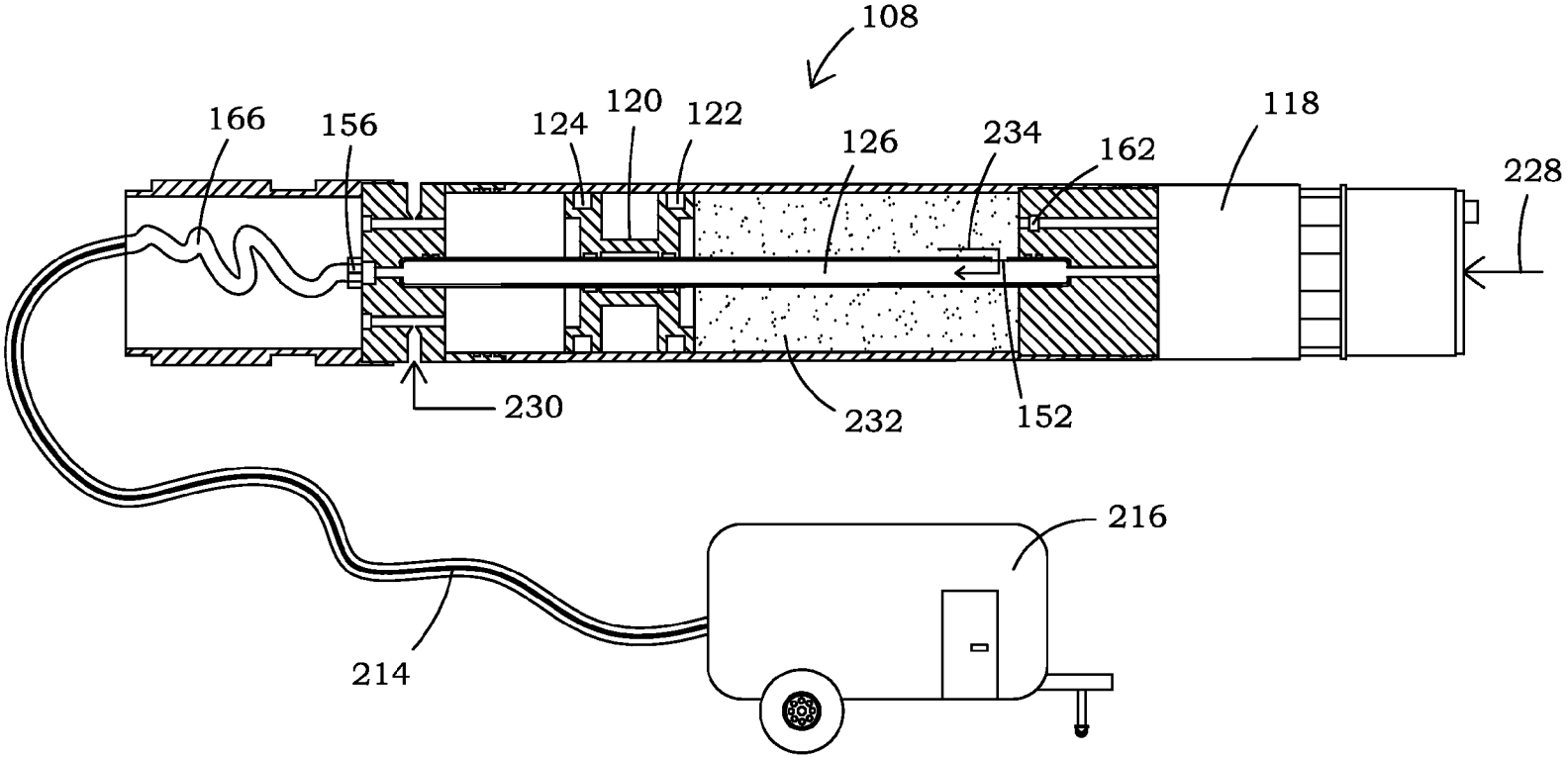
FIG. 20D is an elevational view, partially in section, showing the canister with a pressure hose connection to retrieve the recovered fluids midway through the recovery in accord with one possible embodiment of the present invention.
Figure 20E:
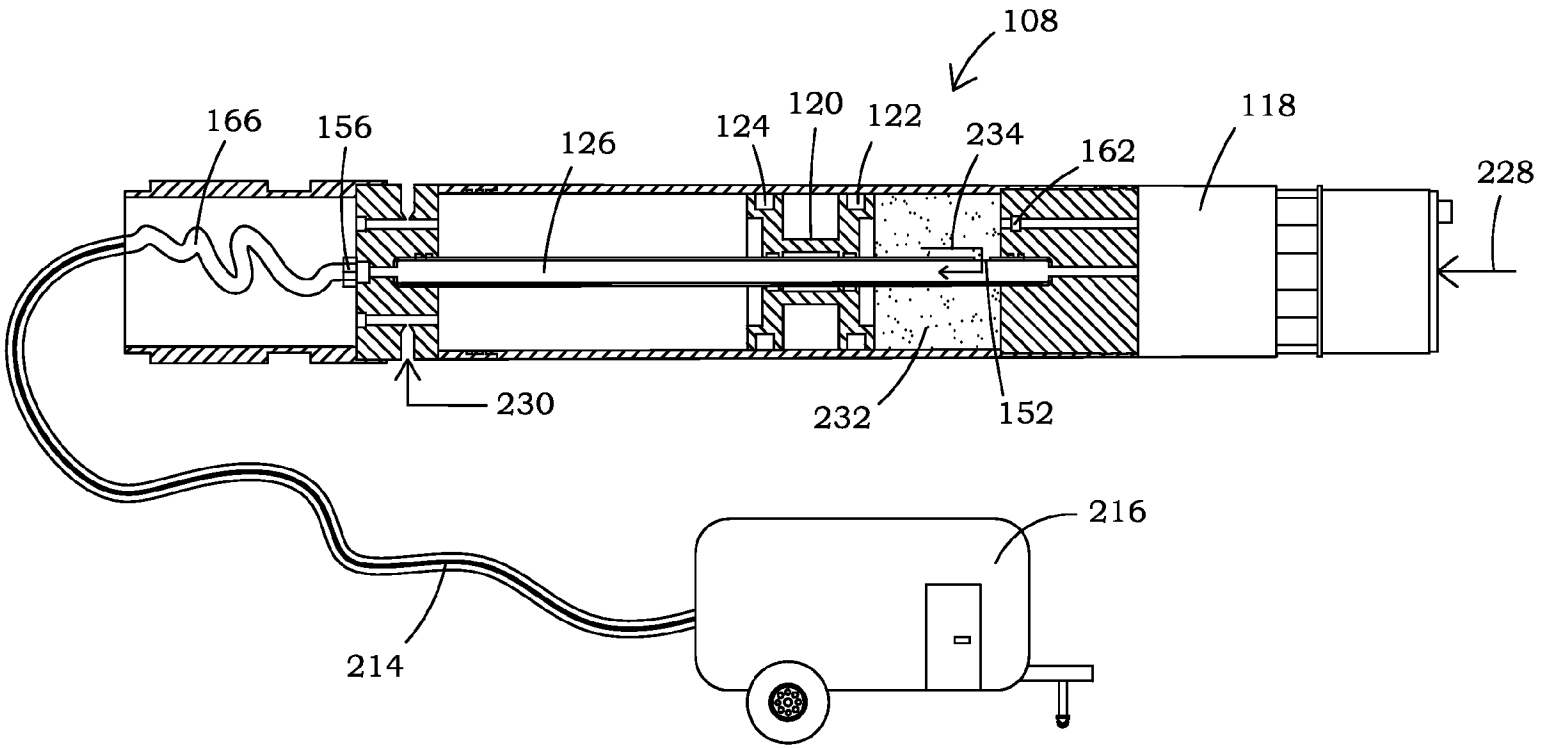
FIG. 20E is an elevational view, partially in section, showing the canister with a pressure hose connection to retrieve the recovered fluids almost through the recovery in accord with one possible embodiment of the present invention.
Figure 20F:
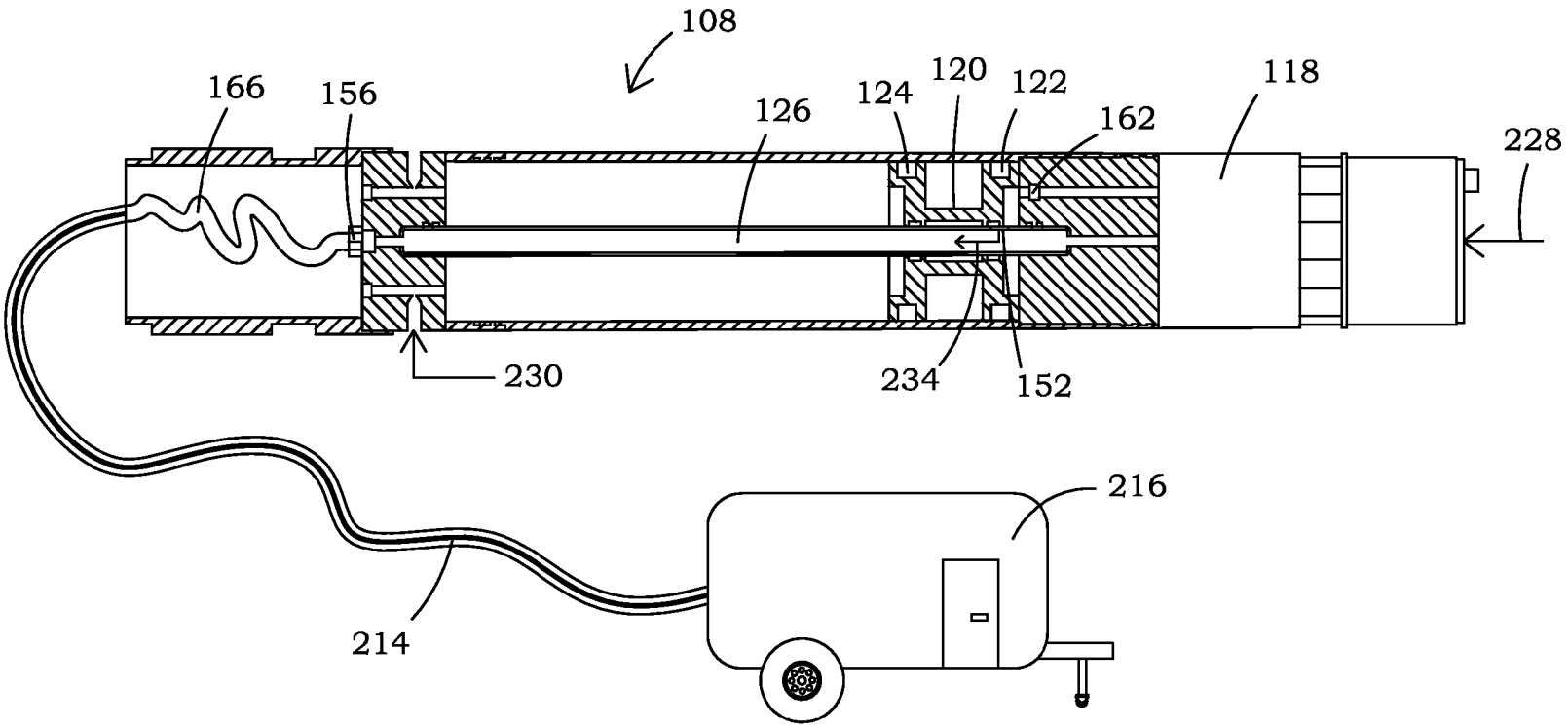
FIG. 20F is an elevational view, partially in section, showing the canister with a pressure hose connection to retrieve the recovered fluids after the recovery in accord with one possible embodiment of the present invention.

In FIG. 20C, which shows a partial cross-section of fluid canister 108 where hoses 214 and 166 are connected together. If the canister fluids are desired to be collected, then pressure is then applied to piston 120 through one of the wellbore openings as indicated by input fluid flow arrow 230, such as by a manual hydraulic pump or the like. Check valve 228 holds the pressure at the bottom end, as discussed hereinbefore. Accordingly, collected core fluid 232 then flows through opening 152 in fluid flow passageway tube 126 and is collected through pressure hoses 214 and 166 into onsite laboratory 216. In FIG. 20D and FIG. 20E the process continues as piston 120 is pumped in the reverse direction within fluid canister 108. In FIG. 20F, piston 120 is bottomed out thereby pushing remaining fluids out of fluid canister 108.

In summary of the above embodiments, for pressure coring, instead of maintaining the core at the bottom hole pressure as the core is transported to the surface, the present invention allows the pressure of the core to decrease based on a selected differential pressure operated valve(s).

While the selected differential pressure at which the valve(s) operates could be a range of pressures, e.g. 250 to 1500 psi, in one embodiment, the differential pressure is about 500 psi.

After cutting core a core of desired length, e.g., cutting 10' of 3" diameter core in high pressure formations, the method of the invention then involves tripping out of the hole. The pressure on the outside of the inner tube will then decrease due to a shorter fluid column in the well bore. Once the differential pressure reaches a desired differential, e.g. 500 psi, then a pressure relief valve between the inner barrel and a first canister opens and gas begins to transfer from the core to the first canister. Once the first canister is full, a second relief valve may be opened to operate a second canister, and so on. Once on surface, the canisters and the core can be transported to the lab where all of the gas is measured.

When utilizing pipe to retrieve the coring tool, in accord with another possible embodiment of the present invention, the gas canisters operate as discussed hereinbefore. As with the wireline retrieved tool, many different types of bottom valves may be utilized to seal off the bottom of the coring tool. Regardless of the type of bottom valve utilized, in accord with the present invention the pressure within the tool is limited so as to provide a safe working tool on the surface as well as to capture all or virtually all fluids. In one possible embodiment, wireline may be utilized to activate bottom valve. For example, the bit shank latch could be provided, and the tool pulled upwardly by wireline to activate the bottom hole valve utilizing any of the above discussed bottom valves and related activating mechanisms. After the valve is activated, the tool may be pulled into another latch or catch after activating the bottom valve, the wireline detached and retrieved, and then the pipe and coring tool is retrieved in the conventional manner. In another embodiment, drill pipe fluid activated mechanisms may be utilized for activating the bottom valve and/or moving the core prior to closing the valve.

It is also to be understood that the foregoing descriptions of preferred embodiments of the invention have been presented for purposes of illustration and explanation and it is not intended to limit the invention to the precise forms disclosed. It is to be appreciated therefore that various structural and circuit changes, many of which are suggested herein, may be made by those skilled in the art without departing from the spirit of the invention.

What is claimed is:

1. A coring tool retrievable to a surface position from a wellbore to obtain a cored formation from said wellbore, said coring tool being receivable within an outer barrel, a coring bit being interconnected with said outer barrel, comprising:

an inner barrel operable to receive said cored formation within a core receiving region of said inner barrel;

a bottom valve operable to seal off an end of said inner barrel; and at least one canister receivable within said outer barrel, said at least one canister comprising an expandable chamber connected to receive and store a fluid flow out of said cored formation in said inner barrel when said inner barrel and said at least one canister are retrieved from said well, said at least one canister being axially spaced from said core receiving region of said inner barrel and being on an opposite side of said inner barrel from said coring bit;

a fluid flow path between said core receiving region and said at least one canister through which said fluid flow out of said cored formation passes into said at least one canister;

and a relief valve mounted in said fluid flow path between said canister and said core receiving region constructed to be operable to open and close, said relief valve being operable to initially obstruct said fluid flow from said core receiving region to said at least one canister and subsequently allow said fluid flow in order to limit pressure in said core receiving region.

2. The coring tool of claim 1, wherein said relief valve is responsive to a differential pressure to control said fluid flow from said cored formation in said inner barrel to said at least one canister.

3. The coring tool of claim 1, wherein said at least one canister further comprises a piston which is moveable in response to a differential pressure between an inside and an outside of said expandable chamber to vary a size of said expandable chamber.

4. The coring tool of claim 1, further comprising said relief valve being operable to prevent fluid flow to said expandable chamber until said relief valve opens whereby pressure builds in said core receiving region to increase a closing force which holds said bottom valve closed.

5. The coring tool of claim 4, further comprising said relief valve being constructed for control of said pressure by opening and closing responsively to a predetermined amount of differential pressure.

6. The coring tool of claim 1, wherein said inner barrel is constructed to be wireline retrievable and further comprising a mechanism in said at least one canister connected to receive fluid flow through said relief valve and further comprising relatively sliding members to move said cored formation past said bottom valve.

7. The coring tool of claim 1, further comprising a recording module with at least one sensor mounted in communication with said expandable chamber operable to record pressure and temperature within said expandable chamber in said canister.

8. The coring tool of claim 1, wherein said bottom valve further comprises a flapper, a support mounted radially inwardly of said flapper that holds said flapper in an open position, said flapper comprising a curve to fit around said support, and a seat for said flapper that conforms to said curve.

9. The coring tool of claim 1, further comprising a plurality of canisters which are configured to sequentially receive and store said fluid flow from said cored formation in said inner barrel as said coring tool is retrieved from said well.

10. A coring tool retrievable to a surface position from a wellbore to obtain a cored formation from said wellbore, comprising:

an inner barrel which is operable to receive said cored formation;

a bottom valve operable to seal off an end of said inner barrel;

a bottom valve mechanism operable to move said cored formation away from said bottom valve prior to closing said bottom valve; and a flapper for said bottom valve;

a support mounted radially inwardly of said flapper within said bottom valve to prevent said bottom valve from closing, said support being moveable with said bottom valve mechanism to allow said bottom valve to close, said flapper comprising a first non-planar surface that fits around said support, a seat comprising a second non-planar surface, said second non-planar surface conforms to said first non-planar surface of said flapper when said flapper engages with said seat to form a seal between said flapper and said seat; and at least one canister operable to receive and store a fluid that flows out of said cored formation in said inner barrel as said coring tool is retrieved from said well and a relief valve through which said fluid flows, said relief valve constructed to be operable to open and close.

11. The coring tool of claim 10 wherein said bottom valve mechanism of said coring tool comprises an expandable portion which increases a length of said coring tool prior to closing said bottom valve, and said support is tubular, said inner barrel being wireline retrievable.

12. The coring tool of claim 10, further comprising a recording module operable to record pressure and temperature of said fluid with at least one sensor mounted in communication with an expandable chamber within said canister, said flapper being spring mounted.

13. The coring tool of claim 10, further comprising said at least one canister is responsive to a differential pressure between a pressure outside said at least one canister and a pressure in said inner barrel to control a flow of said fluid from said cored formation into said at least one canister, said relief valve being operable to open and close during an ascent of said inner barrel after said inner barrel is removed from a bottom of said wellbore.

14. The coring tool of claim 10, further comprising said at least one canister comprising an expandable chamber.

15. The coring tool of claim 14, further comprising a piston in said at least one canister that is moveable in response to a change in a pressure outside said at least one canister to increase a volume of said expandable chamber.

16. The coring tool of claim 10, further comprising multiple pressure canisters and multiple differential pressure operated relief valves which control fluid communication between said cored formation and said multiple pressure canisters to provide sequential operation of said multiple pressure canisters.

17. The coring tool of claim 10, wherein said inner barrel is wireline retrievable.

18. The coring tool of claim 10, further comprising said at least one canister comprising an expandable chamber, and a recording module operable to record pressure and temperature within said expandable chamber.

19. A coring tool retrievable to a surface position from a wellbore to obtain a cored formation from said wellbore, comprising:

an inner barrel which is operable to receive said cored formation within a core receiving region;

a bottom valve operable to seal off a bottom of said inner barrel, said bottom valve comprising a flapper, said flapper being configured to utilize a pressure in said core receiving region from said cored formation to increase a flapper closing force which holds said flapper closed against a flapper valve seat;

a canister connected to receive a fluid flow that flows out of said cored formation; and a relief valve mounted in a fluid flow path between said core receiving region and said canister operable to initially prevent said fluid flow to said canister and to subsequently allow said fluid flow in order to release additional pressure in said inner barrel with said fluid flow into said canister, said relief valve being configured to be operable to open during an ascent of said inner barrel in said wellbore after said inner barrel is removed from a bottom of said wellbore.

20. A method for making a coring tool retrievable to a surface position from a wellbore to capture a cored formation from said wellbore, comprising:

providing an inner barrel which is operable to receive said cored formation;

providing a bottom valve operable to seal off a bottom of said inner barrel;

providing at least one canister to receive and store a fluid that flows in a fluid flow path out of said cored formation into said at least one canister;

providing at least one relief valve in said fluid flow path to initially obstruct fluid flow to said at least one canister and subsequently allow said fluid flow in order to limit pressure in said inner barrel, and providing that said at least one relief valve is operable to open and close.

21. The method of claim 20 comprising providing a support to initially hold said bottom valve in an open position, providing that said bottom valve is a flapper valve, providing that said relief valve is operable to produce an initial build-up of pressure in said inner barrel to hold said flapper valve closed after said support moves to permit said flapper valve to close;

providing a flapper for said flapper valve, and providing that said flapper comprises a first non-planar surface to fit around said support, and providing a seat comprising a second non-planar surface for said flapper that conforms to said first non-planar surface of said flapper when said flapper engages with said seat to form a seal between said flapper and said seat.

22. The method of claim 21, comprising providing a piston in said coring tool which utilizes decreasing well bore drilling fluid pressure as said inner barrel is retrieved to said surface position to control a flow of said fluid from said cored formation in said inner barrel to said at least one canister, and providing that said inner barrel is wireline retrievable.

23. The method of claim 20, comprising providing that said at least one relief valve opens and closes responsively to a differential pressure between said at least one canister and said inner barrel.

24. The method of claim 20, comprising providing that said coring tool comprises a moveable portion that is operable to move said cored formation in said inner barrel past said bottom valve prior to said bottom valve closing, and further providing that said inner barrel is sized to obtain cores greater than three inches in diameter.

* * * * *